United States Patent [19]

Hazelett et al.

[11] Patent Number: 4,674,558

[45] **Date of Patent: * Jun. 23, 1987**

[54] METHODS FOR SHAPING THE CASTING REGION IN A TWIN-BELT CONTINUOUS CASTING MACHINE FOR IMPROVING HEAT TRANSFER AND PRODUCT UNIFORMITY AND ENHANCED MACHINE PERFORMANCE

[75] Inventors: Robert W. Hazelett, Winooski, Vt.; Samuel R. Hazelett, Provo, Utah

[73] Assignee: Hazelett Strip-Casting Corporation, Colchester, Vt.

[ * ] Notice: The portion of the term of this patent subsequent to Nov. 12, 2002 has been disclaimed.

[21] Appl. No.: 608,482

[22] Filed: May 8, 1984

Related U.S. Application Data

[63] Continuation of Ser. No. 330,726, Dec. 14, 1981, abandoned.

[51] Int. Cl.[4] ..... B22D 11/06

[52] U.S. Cl. ..... 164/481; 164/431

[58] Field of Search ..... 164/431, 432, 481

[56] References Cited

U.S. PATENT DOCUMENTS

| | | | |
|---|---|---|---|
| 3,426,836 | 2/1969 | Altenpohl et al. | 164/481 |
| 3,933,193 | 1/1976 | Baker et al. | 164/432 |
| 4,190,103 | 2/1980 | Sivliotti et al. | 164/432 |

*Primary Examiner*—Nicholas P. Godici
*Assistant Examiner*—Richard K. Seidel
*Attorney, Agent, or Firm*—Parmelee, Bollinger & Bramblett

[57] ABSTRACT

Methods for continuously casting metal product directly from molten metal confined and solidified in a casting region defined by upper and lower, cooled, endless, flexible, traveling, casting belts supported by belt support systems including back-up rollers in respective upper and lower carriages and laterally defined by first and second traveling side dams. The back-up rollers and belt support systems shape and maintain the casting region for improved heat transfer between cast metal and belts for improved product uniformity and enhanced machine performance. Several methods are disclosed including having one belt flexibly constrained, resulting in a transverse bowing away from the casting centerline due to liquid metal head, with the opposing belt being rigidly constrained and contoured or transversely bowed towards the casting centerline in a configuration that compensates for displacement of the flexibly constrained belt resulting in a uniform transverse cross section. Methods are disclosed including bowing the upper back-up rollers down either by manual adjustment or remote control and at the same time allowing the lower rollers to yield; intentionally rigidizing the upper and/or lower back-up rollers or sections thereof; bowing both sets of back-up rollers in equal and opposite directions, bowing the rollers inward or outward using either manual adjustment or remote control tensioning; bending structural frame members which are in support relationship with rollers, thus maintaining predetermined configurations of rollers in contact with the belts and further including downstream tapering of the casing region.

9 Claims, 31 Drawing Figures

Fig. 26.
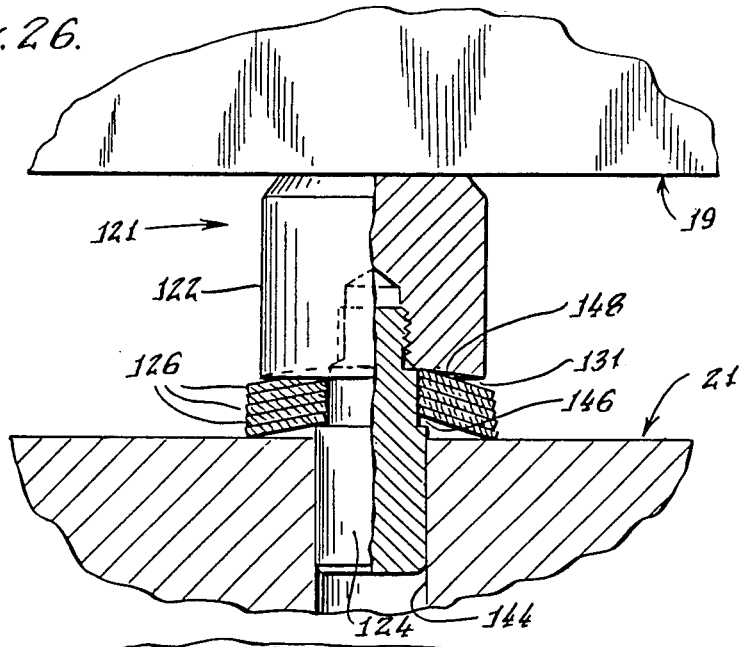
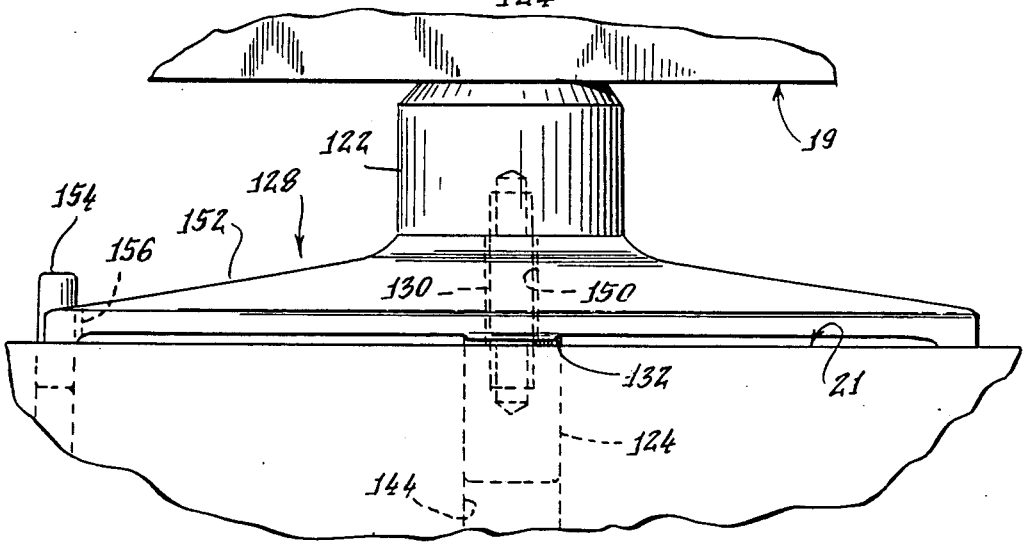
Fig. 27.

METHODS FOR SHAPING THE CASTING REGION IN A TWIN-BELT CONTINUOUS CASTING MACHINE FOR IMPROVING HEAT TRANSFER AND PRODUCT UNIFORMITY AND ENHANCED MACHINE PERFORMANCE

RELATED APPLICATION

This application is a continuation of application Ser. No. 330,726, filed Dec. 14, 1981, now abandoned.

BACKGROUND OF THE INVENTION

This invention relates to continuous casting machines for continuously casting metal ingot, strip, slab or bars directly from molten metal in a casting region defined between spaced portions of a pair of revolving, flexible, endless casting belts which are moved along with the metal being cast, often called twin-belt casting machines or twin-belt casters.

The invention is described as embodied in the structure and operation of twin-belt casting machines in which the molten metal is fed into a casting region between opposed, portions of a pair of moving, flexible belts. The moving belts confine the molten metal between them and carry the metal along as it solidifies into a bar, strip, slab, or ingot, hereinafter called the "cast product" or "product being cast" or similar words. Back-up means, usually rollers having narrow circumferential ridges or fins support and guide the belts while holding them accurately positioned and aligned as they move along so as to produce the cast metal product.

These back-up rollers are positioned across the machine carriages so as to roll passively when the casting belt grazes each of them under pressure of the head of molten metal and/or the weight of the metal. Their circumferential fins permit the passage of cooling liquid along the respective casting belt without notably impeding heat transfer themselves. The fins have often been made separately from the roller shafts, but in current machines the fins and shafts are now often made integrally as one piece of metal. Vast quantities of heat liberated by the molten metal as it solidifies are withdrawn through the portions of the two belts which are adjacent to the metal being cast. This large amount of heat is withdrawn by cooling the reverse surfaces of the belts by means of the rapidly moving liquid coolant traveling along these surfaces. The edges of the molten product are contained between a spaced pair of side dams in the form of a plurality of blocks strung together on flexible metal straps to form a pair of endless flexible assemblies suitable for containing the molten metal as it solidifies.

Background information on twin-belt casting machines will be found in U.S. Pat. Nos.

| Patent No. | Inventor(s) |
|---|---|
| 2,640,235 | Hazelett |
| 2,904,860 | Hazelett |
| 3,036,348 | Hazelett et al |
| *3,123,874 | *Division of No. 3,036,348 |
| *3,142,873 | *Division of No. 3,036,348 |
| *3,228,072 | *Division of No. 3,036,348 |
| 3,041,686 | Hazelett et al |
| 3,167,830 | Hazelett et al |
| 3,310,849 | Hazelett et al |
| 3,828,841 | Hazelett et al |
| 3,848,658 | Hazelett et al |
| 3,864,973 | Petry |
| *3,921,697 | *Division of No. 3,864,973 |

-continued

| Patent No. | Inventor(s) |
|---|---|
| 3,865,176 | Dompas et al |
| *3,955,615 | *Division of No. 3,865,176 |
| *4,155,396 | *Division of No. 3,865,176 |
| 3,878,883 | Hazelett et al |
| *3,949,805 | *Division of No. 3,878,883 |
| *3,963,068 | *Division of No. 3,878,883 |
| 3,937,270 | Hazelett et al |
| *4,002,197 | *Division of No. 3,937,270 |
| *4,062,235 | *Division of No. 3,937,270 |
| *4,082,101 | *Division of No. 3,937,270 |
| 3,937,274 | Dompas |
| 4,092,155 | Dompas et al |
| 4,150,711 | Hazelett et al |

In machines of this type, the moving belts are thin and are cooled by substantial quantities of liquid coolant, usually water containing corrosion inhibitors. This coolant withdraws heat through the casting belts and serves to cool the metal from its molten state as it enters at one end of the machine causing it to solidify as it passes through the machine.

The molten metal pushes outwardly on the belts due to metalostatic pressure or "head". Solidification of the metal product takes place from outside to inside so that, through some of its passage through the machine, it is in the form of a solidified shell having a molten, constantly decreasing, interior volume. It will also be understood that, as the metal cools and solidifies, it shrinks. The shrinkage is very slight but, nevertheless, is sufficient to cause surface regions of the metal sometimes to pull away from the moving belts or from the side dams. When this separation between areas of the metal surface and the cooling surface occurs, non-uniform cooling is caused, which results in non-uniformities in the parameters of the casting region and in non-uniformities in the cast product.

This invention in certain aspects is especially applicable to casting machines which produce ingot or slab of a width in excess of 25 inches (635 mm). Such twin-belt casting machines are generally inclined downward in use, so as to result in a head—that is, a static pressure—of liquid metal in order to fill out the casting region, i.e. the mold cavity, and to thereby press the casting belts decisively against their back-up supports. Further, by use of open-or closed-pool pouring technique, the entry of molten metal into the machine is facilitated by operating the machine at some downward incline. The aforesaid head of molten metal depends on the angle of incline, the density of the molten metal being cast, and the distance to the point of final solidification in the machine.

The force of such liquid metal head is exerted upon the casting belts and thence upon the guides or back-up supports for the belts, which we commonly call the mold back-up. Most immediately, this back-up consists of transversely disposed finned back-up rollers. These rollers and their supports have previously been made rigid in order that the ingot or slab of accurately defined and controlled gauge may be cast. The headers bearing liquid coolant can be made to serve the additional duty of providing rigid supports for the back-up rollers. Some wide machines have in their carriages central longitudinal beams or sills to lend their additional rigidity to the back-up system, for resisting the force of the molten metal to be counteracted as it presses outwardly on the wide casting belts.

The very rigidity of the above described prior art back-up means can combine with the shrinkage inherent in the freezing and cooling of the product being cast to allow air spaces to intervene between the freshly cast surface and the casting belts. These intruding spaces substantially reduce the rate of heat transfer and may render it non-uniform, with a corresponding effect on the rate and uniformity of product cooling and solidification. The reduced rate and uniformity of cooling limits the production rate, or else it requires the use of longer casting machines than would otherwise be needed.

An associated problem with the aforesaid air spaces or gaps occurring between the cast metal surface and the mold surfaces defining the casting region is the consequent degradation of the desired fine, quick-chilled crystalline structure in the cast product into coarser crystals. Such air spaces or gaps can permit the localized remelting of the cast product with consequent bleeding, or sweating of molten material from the previously cast shell itself and/or from the molten metal inside of the shell causing segregation and/or porosity in the cast product. This reheating or remelting will not occur if good mold contact is maintained.

Problems of local excess pressure can occur with a rigid mold when excess thickness is somehow frozen locally. Thus, the relatively thin casting belts will become locally overheated with a corresponding localized area of increased heat transfer due to the high localized belt pressure against the partially solidified product. Also, if a frozen piece of metal of excess thickness is inadvertently drawn into the caster, a slitting of the belt by the narrow fins of the back-up rollers or considerable damage to the precise, rigid mold back-up mechanisms can result.

SUMMARY OF THE INVENTION

It is an object of the present invention to provide methods for continuously casting metal products of high quality directly from molten metal wherein flexibility and control of the transverse shape of the casting region are provided.

Continuous casting methods are advantageously provided wherein the contact pressures between the casting belts and the metal product are controlled and are maintained along the length of the metal to insure uniform heat extraction from the solidifying metal product.

One preferred method of shaping the casting region by action of the back-up system is to arrange for constant parallel thickness in the upstream casting region, before the product being cast is solidified enough to retain its shape, and to allow springy bowable rollers and back-up supports to converge in the downstream portion of the casting region as the largely solid product contracts due to loss of heat.

It is convenient in twin-belt casting machines to make structural use of the transverse headers carrying the cooling liquid to the nozzles which apply the coolant over the casting belts. This convenience is important in view of the lack of space for transverse beams in the belt carriages. In downstream areas of the carriages where less coolant is needed because the product has already formed its solidified shell, there is room for such special transverse beams. The relative bowability of such transverse support beams and coolant headers enters into the total effective bowability of the array of back-up rollers.

There are various aspects of the methods of the present invention for shaping the casting region. In certain aspects, the "head" of the molten metal is predetermined and is used as the driving force for bowing or deflecting the back-up rollers and their support systems in one carriage only, preferably those in the upper carriage while the back-up rollers and support systems in the other carriage are rigid; and predetermined bowability is intentionally provided in the back-up rollers and in their support systems in said one carriage for responding to this force of the head of molten metal, while the back-up rollers in the other carriage are rigidly constrained. In certain other aspects mechanical adjustment means are used for applying bending forces to the back-up rollers and/or to their support systems for producing bowing of the back-up rollers in one or both carriages for shaping the casting region. In certain additional aspects, remotely controllable bowing means are used for controllably applying bending forces to the bowable back-up rollers in one or both carriages for shaping the casting region.

In accordance with certain aspects of the present invention a first one of the casting belts is flexibly constrained in a predetermined relationship versus the molten metal head values occurring at different locations in the downwardly inclined casting region for enabling this first belt to bow transversely away from the casting centerline due to the predetermined molten metal head values occurring at the various locations, with the second casting belt being rigidly constrained and being transversely bowed toward the casting centerline in a predetermined inward convex configuration that compensates for the various displacements of the flexibly constrained belt, resulting in a uniform transverse cross section for the cast product, while providing improved casting parameters.

Among the advantages of this invention are those resulting from continuously casting metal product directly from molten metal wherein the shape and contact pressure and parameters of the belt supports may be controlled by manual adjustment or by remote control.

In carrying out this invention in certain illustrative embodiments thereof, methods are provided for casting metal product directly from molten metal in order to promote uniform heat transfer from the cast metal to the belts which are continuously liquid cooled. The upper back-up rollers are selectively bowed down either by manual adjustment or by remote control, and the lower back-up rollers are allowed to yield or "float", or vice versa. The methods as disclosed include intentionally rigidizing the upper or lower back-up rollers or sections thereof while the back-up rollers on the other side are allowed to flex in predetermined amounts with the surface of the casting. These methods include bowing both sets of the back-up rollers either inwardly or outwardly; bending structural frame members which are in support relationship with the rollers for flexing the rollers to control belt contour and belt contact with the cast product, etc.

The maintenance of contact between the casting belts and the cast product is controlled by either manual adjustment or remote actuation. In any of the methods the mold configuration may be tapered from the upstream to the downstream end of the continuous casting machines for compensating for shrinkage in the solidifying metal and for providing predetermined mold contact pressures and heat transfer characteristics.

BRIEF DESCRIPTION OF THE DRAWINGS

The invention, together with further objects, aspects, advantages and features thereof will be more clearly understood from a consideration of the following description taken in conjunction with the accompanying drawings in which like elements will bear the same reference designations throughout the various FIGURES:

FIGS. 26 and 27 show two different embodiments of resilient gauge spacers mounted between the side frames of the upper and lower carriages.

DESCRIPTION OF THE PREFERRED EMBODIMENTS

Figure 1:
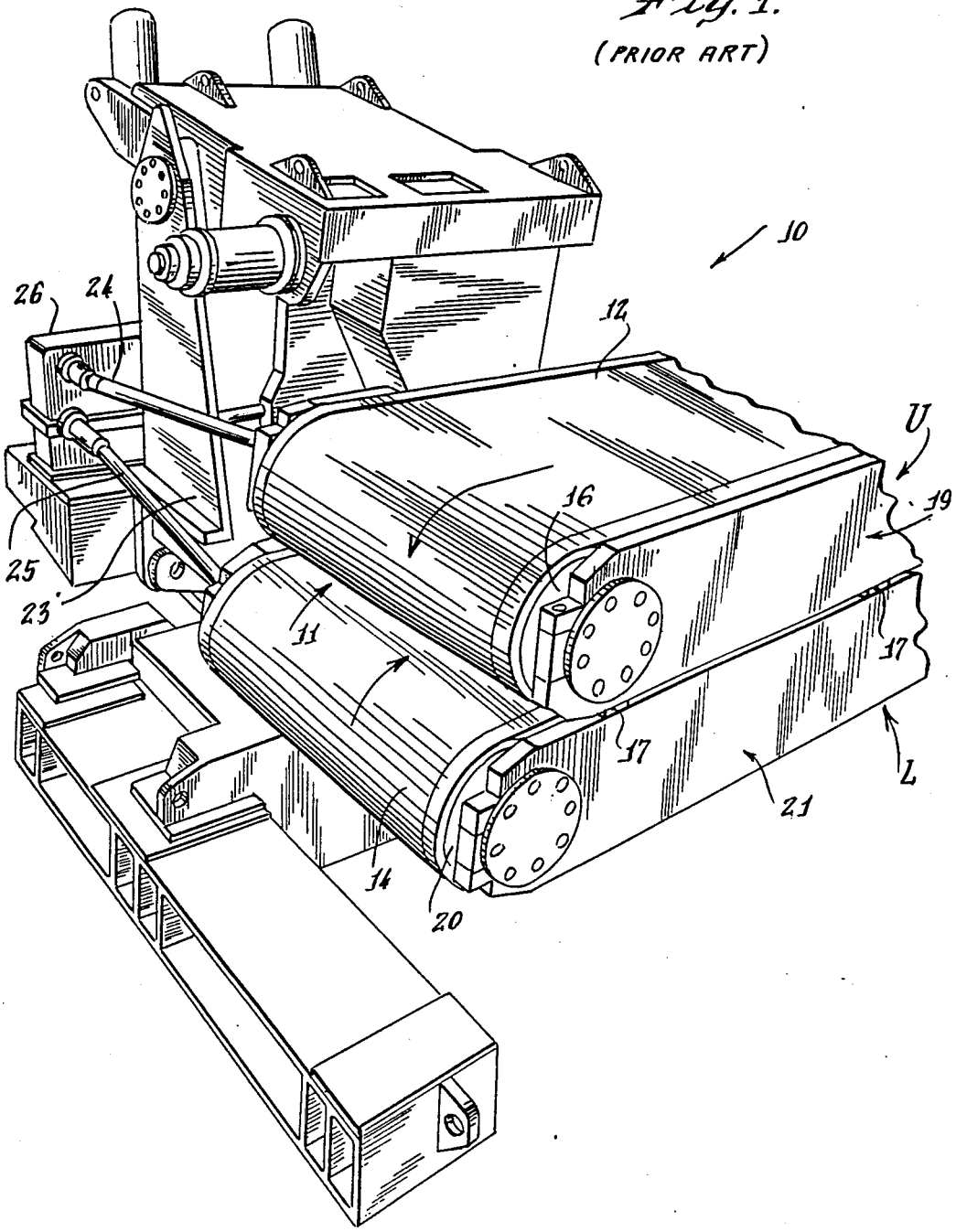
Fig. 1. (PRIOR ART)
FIG. 1 is a perspective view of the input or upstream end of a continuous casting machine embodying the present invention, as seen looking toward the machine from a position in front of and outboard beyond the outboard side of the two belt carriages.

Referring now to FIG. 1, a continuous casting machine, referred to generally with the reference character 10, has molten metal fed into the upstream end or entry 11 of the machine 10 between upper and lower endless flexible casting belts 12 and 14. The molten metal is solidified in a casting region C (FIG. 3) defined by the spaced parallel surfaces of the upper and lower casting belts 12 and 14.

It is noted that FIGS. 1, 2, 3, 4 and 5 show prior art structures, and it is helpful to the reader to understand these prior structures as background for the present invention.

Figure 2:
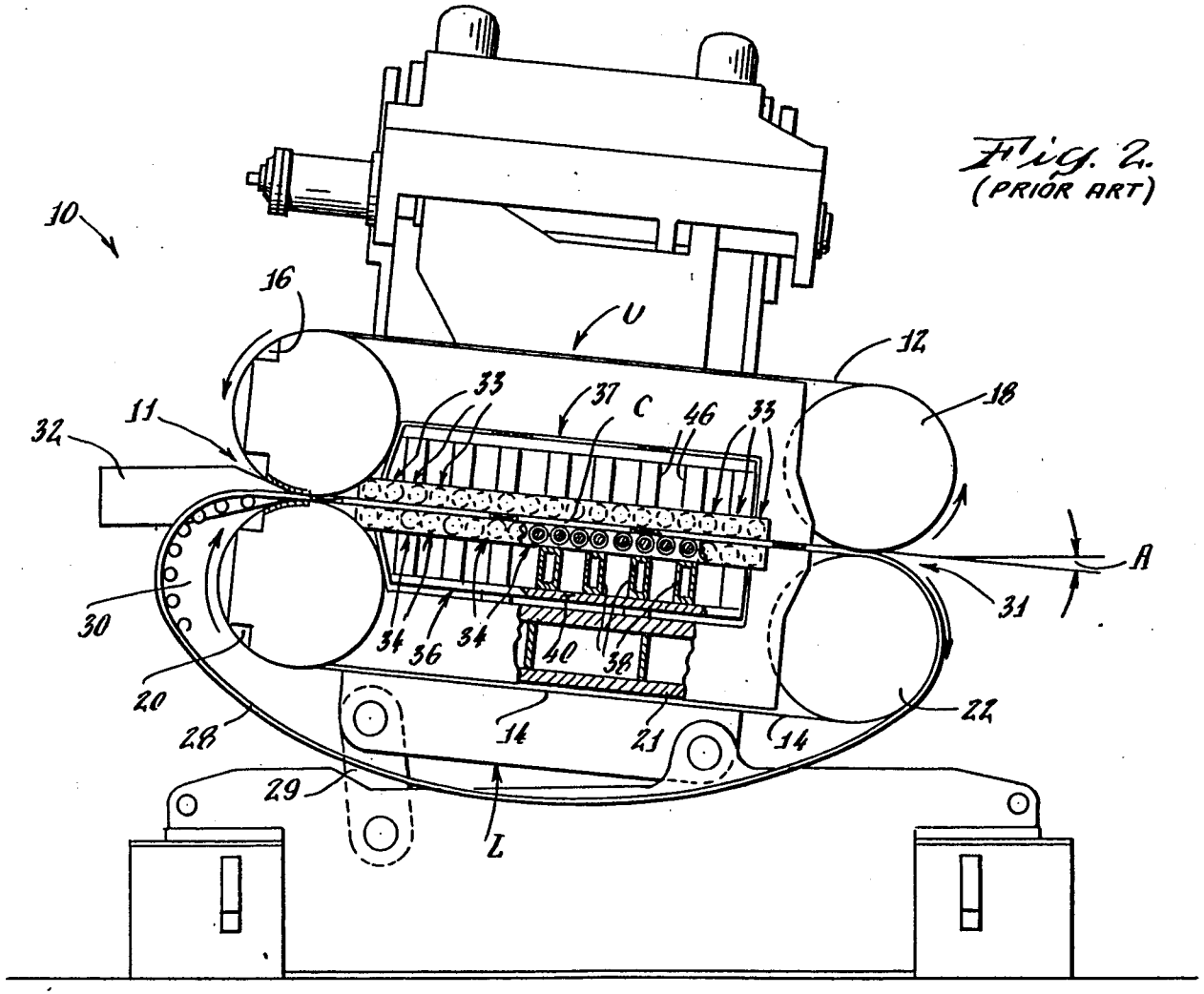
Fig. 2. (PRIOR ART)
FIG. 2 is an elevational view, partly broken away and in section, of a prior art machine as seen looking toward the outboard side of the two belt carriages, showing the casting region downwardly inclined at a predetermined angle of inclination.
Figure 3:
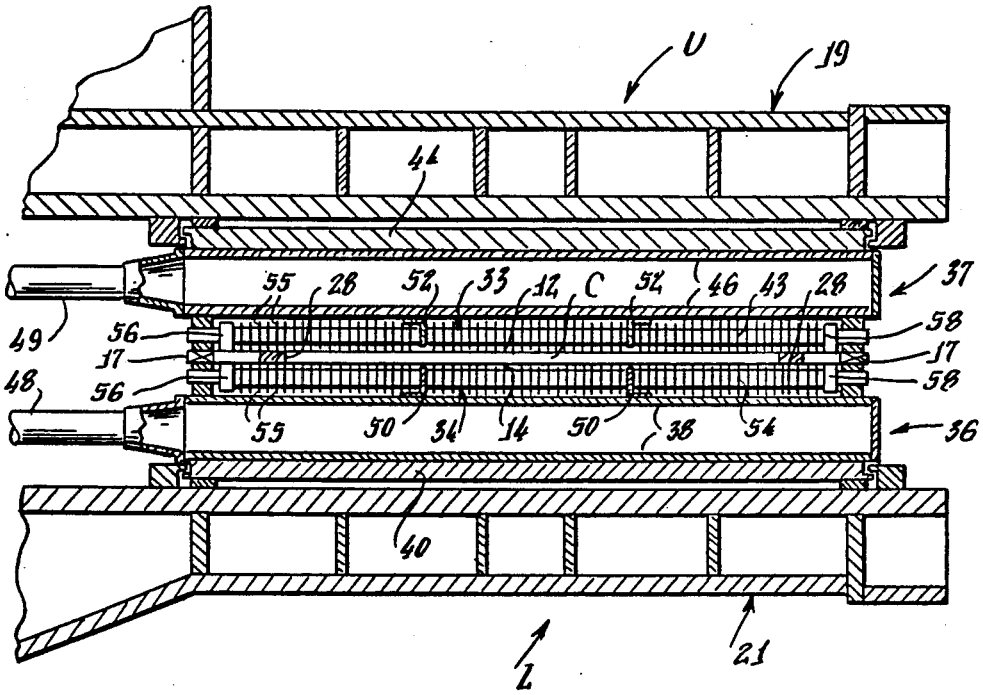
Fig. 3 (PRIOR ART)
FIG. 3 is a cross-sectional view of portions of the two belt carriages of the prior art machine including the liquid coolant headers, back-up rollers, casting belts and side dams showing such back-up means and the associated belts and side dams rigidly defining the casting region.

The casting belts 12 and 14 are supported and driven by means of upper and lower carriage assemblies which are indicated in FIGS. 1, 2 and 3 at U and L, respectively. The carriage assemblies are supported in cantilever relationship from a main frame 23, as seen in FIG. 1. Hence the side of each carriage assembly near this main frame 23 is referred to as being "inboard" while the other side is referred to as "outboard".

The upper carriage U includes two main roll-shaped pulleys 16 and 18 (FIGS. 2 and 5) around which the casting belt 12 is revolved as indicated by the arrows. The pulley 16 near the input end of the machine 10 is referred to as the upstream pulley or nip pulley and the other pulley 18 is called the downstream or tension pulley. Similarly, the lower carriage L includes main upstream (or nip) and downstream roll-like pulleys 20 and 22, respectively, around which the lower casting belt 14 is revolved. In order to drive the casting belts 12 and 14 in unison, the upstream or nip pulleys 16 and 20 of both the upper and lower carriages are jointly driven through universal-coupling-connected drive shafts 24 and 25 by a mechanically synchronized drive 26 driven by an electric motor (not shown).

During the casting operations, the frame 19 (FIG. 1) of the upper carriage assembly U is supported on the frame 21 of the lower carriage assembly L through gauge spacers 17 positioned along the length of the casting region on either side, and the precise thickness of these gauge spacers establishes the mold thickness dimension between the opposed casting faces of the casting belts 12 and 14 and correspondingly the resulting thickness of the cast metal product. Two edge dams 28 (only one of which is seen in FIG. 2) are interposed between the opposed casting faces of the casting belts and are guided. Each edge dam is laterally constrained to establish the cast metal width at the nip or upstream end of the casting machine by an edge dam guide assembly 30.

These two edge dams are driven through frictional contact with the casting belt 12 and 14. The two opposed inner casting faces of these edge dams, together with the two opposed casting faces of the upper and lower casting belts 12 and 14 form four moving casting faces of a moving mold in the casting region C having a generally rectangular cross sectional configuration as seen in FIG. 3. As will be observed in FIG. 2 from the angle "A", the upper and lower carriages U and L are slightly inclined with respect to horizontal so that the casting region C slopes slightly downwardly from the upstream end 11 of the machine 10 to the downstream or exit end 31. Usually the downward inclination "A" is less than 20° from horizontal, and it can be adjusted by means of the jack mechanism 29.

Casting belts 12 and 14 are relatively thin metal belts, for example, of steel which require back-up support and an enormous amount of cooling in order to be able to handle the heat liberated by the solidifying metal in the casting region C. It is desirable to maintain the casting belts 12 and 14 in intimate contact with the cast metal as it solidifies in the casting region, for avoiding air spaces or gaps between the surfaces of the solidifying metal and the casting belts 12 and 14, for reasons as discussed above in the background section. Among the problems is that the metal shrinks as it solidifies. Furthermore, such shrinkage varies somewhat in different areas of the casting region C. The molten metal is initially fed in between the casting belts 12 and 14 from a tundish 32 (FIG. 2) at the upstream end 11 of the casting region C. The molten metal in the downwardly inclined casting region pushes outwardly, i.e., upwardly and downwardly, against the belts due to metalostatic "head" pressure. As it continues downstream in the casting region this "head" pressure increases. Even after a thin shell of cast metal forms around the molten core the head continues to increase, pressing this shell forcefully outward. Then, as the shell thickens and the molten core begins to solidify, the head ceases its outward pressure and thereafter shrinkage of the solidifying product becomes progressively greater in the downstream portions of the casting region.

Generally speaking the shrinkage tends to take place away from the upper belt 12, because the weight of the cast product rests upon the lower belt 14. Thus, the conductive transfer of heat from the solidifying metal into the lower belt tends to be more uniform than the transfer of heat into the upper belt in the downstream portions of the casting region. Wherever the upper belt is locally separated from the upper surface of the solidifying product there is no heat transferred by conduction and a radiant or convective heat transfer occurs. Any separation gaps or spaces between areas of the solidifying metal surface being cast and the belts to which coolant is applied creates hot spots and non-uniform heat transfer which result in crystallographic degradations, segregations, porosity, and imperfections in the cast product as discussed in the background section above.

Figure 4:
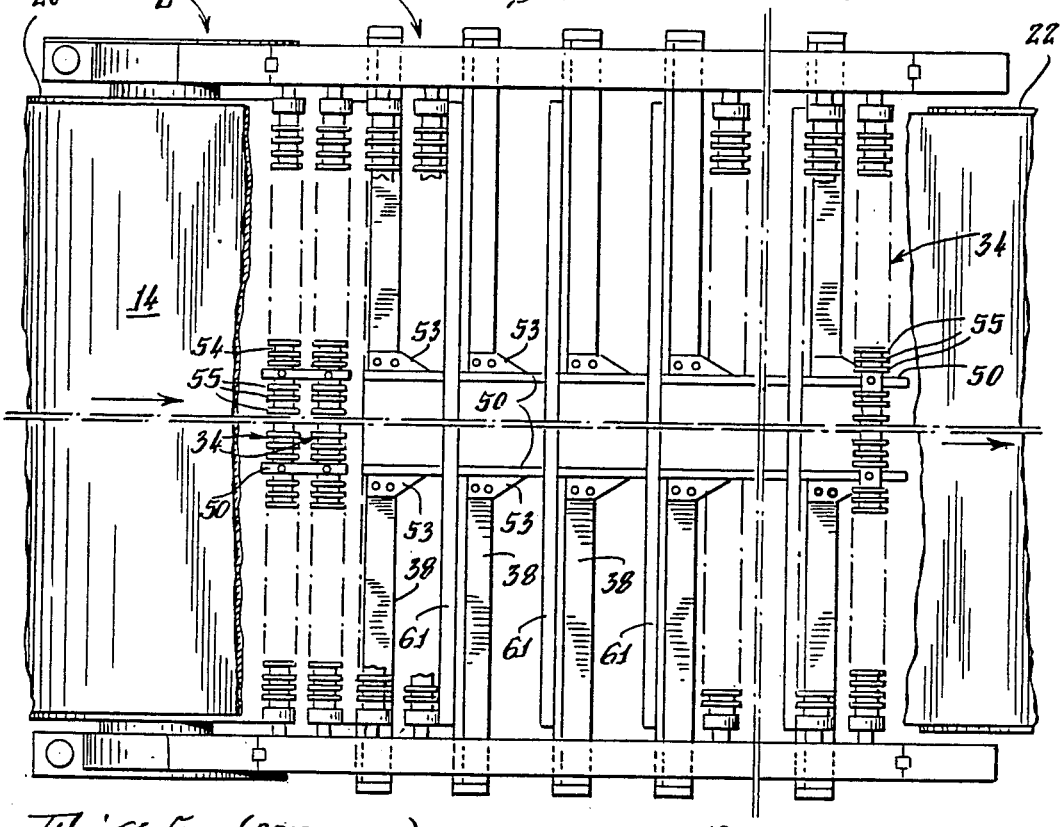
Fig. 4. (PRIOR ART)
FIG. 4 is a top or plan view of the lower carriage of this prior art machine with the belt and parts of other elements cut away for revealing the structure.

As will be seen in FIGS. 2, 4 and 5 the upper and lower belts 12 and 14, respectively, are backed up by a plurality of upper back-up rollers 33 and lower back-up rollers 34, respectively, extending transversely above and below the casting region C. The lower frame 21 in the lower carriage L includes a core section 36 therein, which may be built to be removable as a whole unit. This core section 36 includes a plurality of rigid coolant headers 38 and a frame member 40 by which the lower back-up rollers 34 are supported.

As will best be seen in FIG. 3, the upper carriage U has an upper frame 19 including a similar core section 37 therein which includes a frame member 44 and a plurality of rigid coolant headers 46 which support the upper back-up rollers 33. This core section 37 may be built to be removable as a whole unit.

It is to be understood that these prior art coolant headers 38 and 46 together with their respective frame members 40 and 44 were made as rigid as possible. The coolant headers 38 were each formed with a large rectangular cross sectional shape in the nature of a box beam for resisting significant deflection. The liquid coolant is fed into the rigid headers 38 and 46 through the liquid supply connections 48 and 49. In order to rigidly mount the lower and upper back-up rollers 34 and 33 onto the rigid headers 38 and 46, there are a plurality of laterally spaced longitudinally extending stringers in each carriage in the form of lower L-shaped members 50 and upper L-shaped members 52 secured to the respective headers by brackets 53 (FIG. 4). For further information concerning the structures shown in FIGS. 2, 3, 4 and 5, the reader's attention is invited to U.S. Pat. No. 3,828,841 mentioned in the background section.

The back-up rollers 33 and 34 had solid shafts 43 and 54, respectively, which were either segmented or continuous. When these shafts were segmented, their ends were mounted in bearings rigidly supported on the stringer members 50 and 54 for being as rigid as possible. The inboard and outward ends of the shafts 43 and 54 were mounted in bearing 56 and 58, respectively, so as to be freely rotatable by the moving belts 12 and 14 as they revolved in the carriages. Back-up rollers 33 and 34 have narrow circumferential ridges or fins 55 which are contacted by the upper and lower belts 12 and 14. The cooling fins 55 provide access around the back-up rollers 32 and 34 so that coolant from the headers 38 and 46 may be applied to and maintained travelling rapidly along the reverse surfaces of the casting belts 12 and 14. The headers 38 and 46 have a series of nozzle openings 60 (FIG. 5) along the length thereof and applicator scoops 61 so that liquid coolant is continuously applied to the belts and maintained traveling rapidly along them. By cooling the belts heat is extracted by conduction through the belts from the casting region C which liberates enormous amounts of heat as the molten metal therein cools and solidifies.

Figure 5:
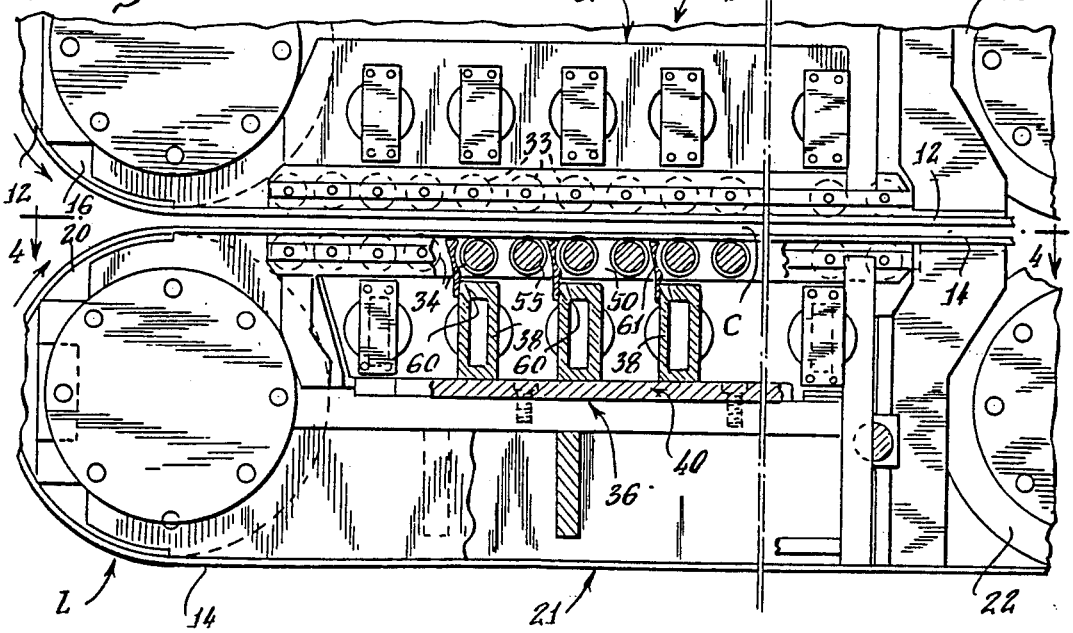
Fig. 5. (PRIOR ART)
FIG. 5 is a partial side view of this machine enlarged as compared with FIG. 2; for convenience of illustration the casting region is shown horizontal, but it is to be understood that the casting region is inclined downwardly as shown in FIG. 2.

In FIG. 5 the casting machine is shown in horizontal position for convenience of illustration, but it is to be understood that the machine actually is inclined downwardly in operation as shown in FIG. 2.

To this point the description of FIGS. 1 through 5 is of conventional structures which have proven to be advantageous over other types of continuous casting methods and machines. In accordance with the present invention a variety of methods are provided for shaping the casting region in a twin-belt casting machine for improving heat transfer and product uniformity and for enhancing machine performance. Among the advantages of such shaping are that the belts will maintain contact with the surfaces of the metal being cast in the casting region in order to provide uninterrupted contact between the belts and the product being cast for providing a predictable heat extraction from the solidifying metal into the belts which is comparable for both the upper and lower belts.

Figure 6:
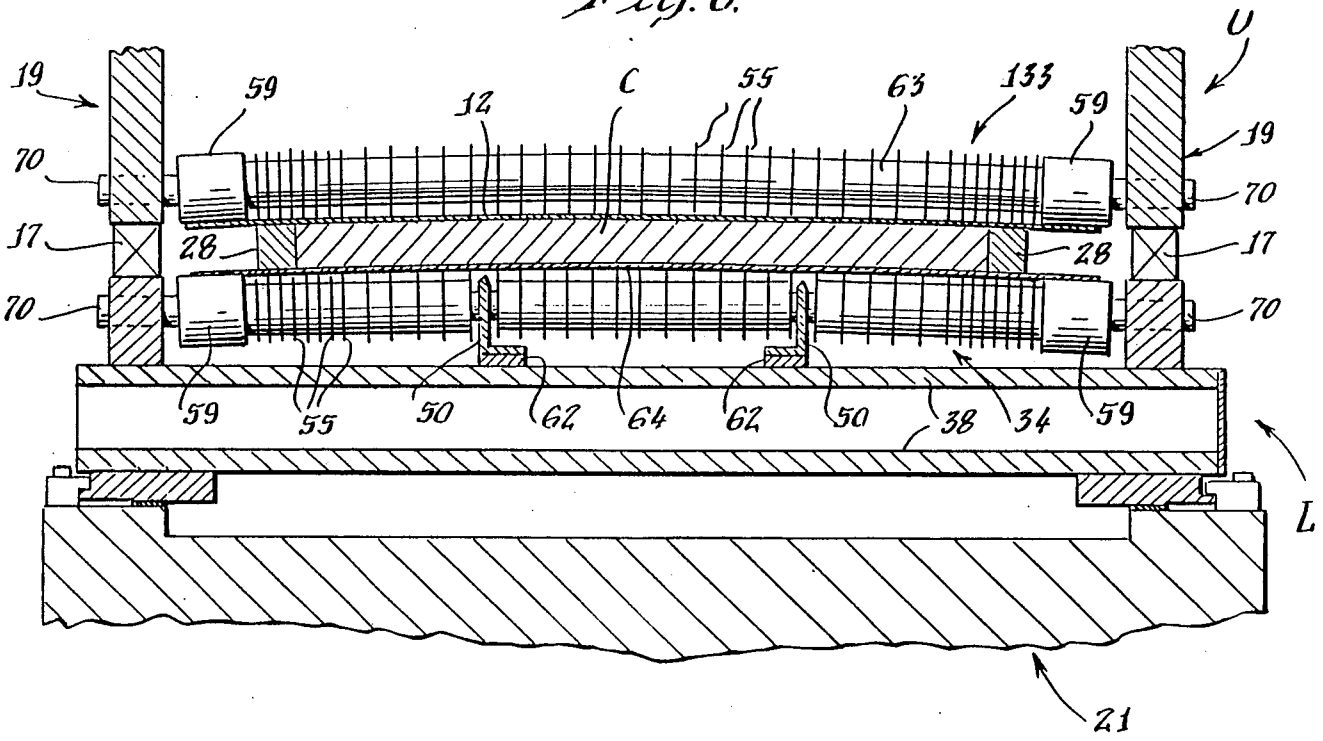
FIG. 6 is a transverse sectional view of the casting region, showing a segmented back-up roller below the lower casting belt, with the segments disposed along a shallow, convex upward arc, in opposition with a flexible back-up roller above the upper belt as it would appear under the pressure of a head of molten metal exerting force from within the casting region between the belts.
Figures 7A, 7B, 7C:
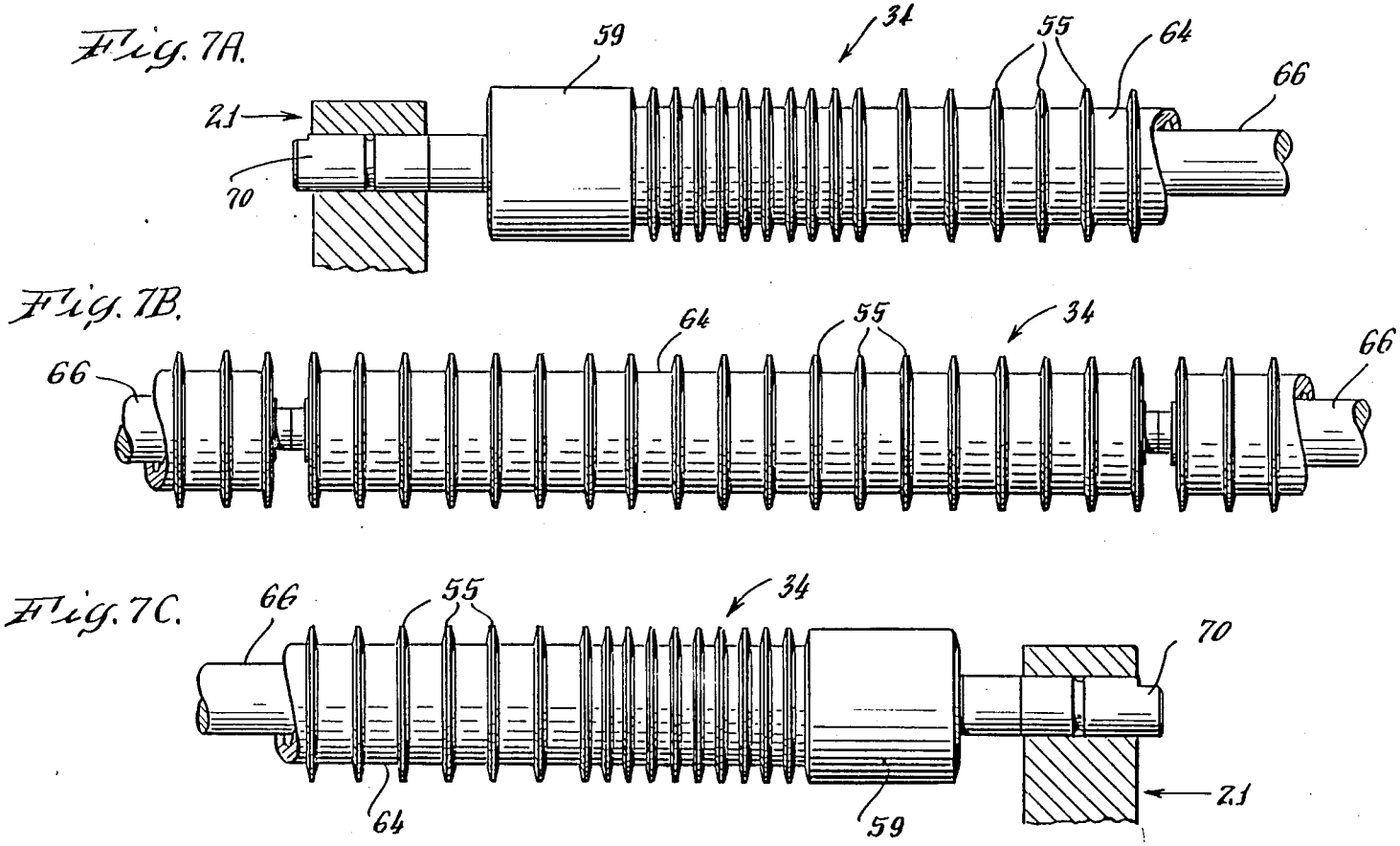
FIGS. 7A, 7B and 7C show an enlarged elevational view of a three-segment back-up roller with integral circumferential fins
Figure 8:
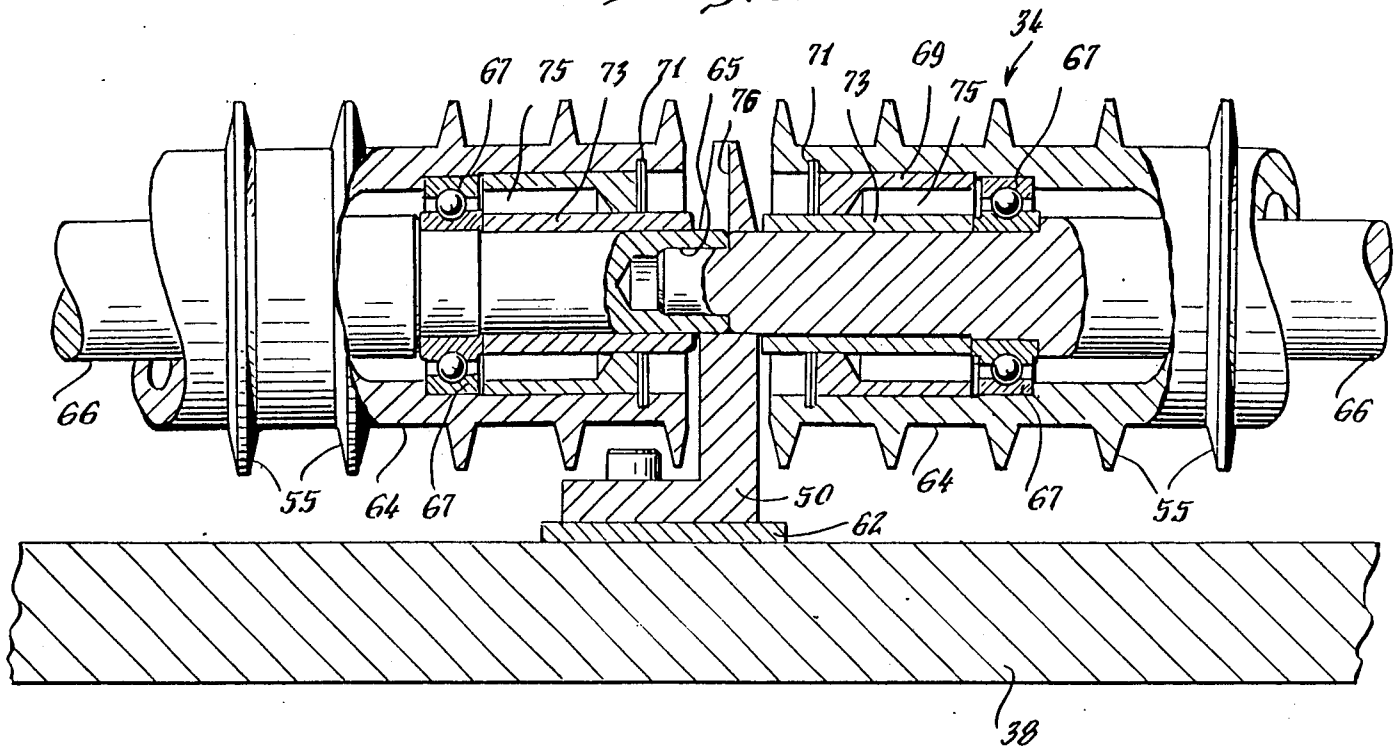
FIG. 8 is a further enlarged partial sectional view of a portion of FIG. 6 showing the means for interconnecting the adjoining ends of two segments of a segmented back-up roller.

In order to assure maintaining contact of both belts with the solidifying metal as shown in FIGS. 6, 7 and 8, the upper back-up rollers 133 are constructed to be flexible for bowing transversely to the casting region C, while the lower back-up rollers 34 are held rigidly in position. The respective roller shafts 63 and 64 both are hollow. Each upper roller shaft 63 is continuous across the full width of the casting region C and is hollow and is constructed with a predetermined bowability. The lower roll shafts 64 are segmented and have internal segmented shafts 66 FIGS. 7 and 8 which are supported at the ends of each of their segments by the support members 50.

In typical installations of such casting machines 10 the density of the metal or alloy intended to be cast and the intended angle of downstream inclination A are specified. Hence, the "head" or pressure of molten metal against the belts at any given back-up roll location along the length of the casting region C is predictable. Also, the flexibility of a beam of uniform cross section under uniform loading per unit of length (namely, each hollow roller shaft 63) is a function of the fourth power of its free length. Since such uniform loading per unit length against each back-up roller is characteristic of the pressure ("head") in the casting region C, the continuous, hollow upper rollers 133 in a wide caster as shown in FIG. 6 are much more flexible (bowable) than the lower rollers 34 which have intermediate supports 50.

Therefore, the end-supported-only upper rollers 133 have predetermined bowability and the loading against them is predetermined. Consequently, the bow which will occur in each upper back-up roller at each position along the length of the casting region is predetermined. In order to compensate for (or offset) the resultant bulge in one surface of the cast product permitted by the flexible back-up system for the belt in one carriage, for example in the upper carriage U as shown in FIG. 6, a convex back-up configuration of a rigidized belt support system in the opposing carriage is provided as shown in FIG. 6. The convex configuration of the rigidized belt back-up system in this opposing carriage, for example in the lower carriage L is predetermined with a convex curvature which will approximately match the predetermined concave curvature of the bowable back-up system. Hence, the cast product will generally be cast to a uniform thickness across its width and will have a slight transverse curvature.

It is to be understood that the transverse curvature shown in FIG. 6 is exaggerated for purposes of illustration. The subsequent rolling operation will remove the slight transverse curvature harmlessly, provided the thickness of the cast product is substantially uniform.

In summary, the compensation for the bulge permitted by the flexible, bowable belt back-up in one carriage is built right into the machine. The desired flexibility and corresponding contoured rigidity may be built into either carriage, but preferably the upper carriage belt back-up is flexible as illustrated in FIG. 6. In other words, we offset and compensate for the lateral bulging permitted by the flexibly constrained back-up support in the, say, the upper carriage by means of rigidly convexly contoured back-up support in the lower carriage. In this method, we retain both mold flexibility and constant product thickness. Such compensation for bulge may be made progressively greater along the direction of casting in the machine, in response to the increasing head of molten metal in that direction and the resulting progressively increasing deflection of the flexible back-up system.

The flexibility of this back-up system will not only prevent the occurrence of gaps or insulating air spaces, but the force exerted by the flexible portion of the back-up system will effectively and controllably maintain belt contact and conductive heat transfer and, moreover, render such heat transfer relatively uniform, with corresponding positive results for the progress of the casting.

The underlying thoughts of this method as described above for FIGS. 6, 7 and 8 may be broadly characterized as "persuasion" rather than attempting coercive domination.

In order to produce the predetermined convex configuration of the lower belt, rigid spacers 62 (FIG. 8) of predetermined thickness are mounted between the rigid headers 38 and the intermediate supports 50 for the segmented rollers 34. As shown in FIG. 8, the adjacent ends of the adjacent sections of the segmented internal shaft 66 are held by the support member 50. One shaft end has a socket 65 which receives the reduced diameter end of the adjacent section of the internal shaft 66. Anti-friction bearings 67 are mounted within the ends of the adjacent sections of the hollow shafts 64 of the lower back-up rollers 34. These bearings 67 are retained against an internal shoulder by means of a spacer sleeve 69 held in place by a retaining snap ring 71, and there is a smaller diameter sleeve 73 providing a space 75 for holding grease. A cut-out space 76 in the support 50 permits socket end of the section of the internal shaft 66 to be removed from the support 50, and similarly in other supports 50 so that the segmented shafts 34 can be individually removed from the carriage and replaced, if desired.

It is to be noted in FIGS. 6 and 7, that there are fixed stub shafts 70 mounted in sockets in the frames 19 and 21, and the bearings 59 at the ends of the back-up rollers 133 and 34 are self-aligning bearings for permitting free rotation of each roller even though its axis is deflected out of alignment with the axis of the stub shaft 70.

It is to be noted, that in view of the bowability of the back-up rollers being a fourth power function of their unsupported length, in the case of a wide casting region C as shown in FIG. 6 the bowability of the end-supported-only, one-piece flexible roller 133 may be greater than the predetermined spring constant value desired, particularly at locations downstream in the machine where the metal "head" pressure is greater. It is not feasible to attempt to decrease their bowability (i.e. increase their spring constant) by increasing their hollow shaft 63 diameter beyond a modest amount, because these back-up rollers are intended to be closely spaced longitudinally along the casting region for appropriately supporting the belt. Too large a shaft diameter would interfere with close roller spacing.

Consequently, for wide casting regions C in order to limit the effective bowability (i.e. to increase the effective spring constant of the rollers 133) external means 98, 100 (FIG. 9) may be employed. For the purpose of thus modifying roller flexibility, rolling external back-up bearings 98, 100 for each said flexible back-up roller 133 may be placed close to the roller shaft 63 and external to it, said bearings being able to roll against said shaft 63 in the manner of a roller wheel, one per location (see FIG. 9).

Yet this external flexibility modification is not intended for sharply limiting the elastic bending of back-up rollers, since any absolute rigidity in the back-up system may cause damage by the passage of stray, prematurely frozen metal. We prefer to mount said external back-up roller wheel bearing 98 resiliently, in order that they may themselves flex away from the casting region. Thus, the roller wheel 98 is mounted in a bracket 99 which in turn is seated upon a resilient mounting member 100 on the rigid header 46. This resilient mounting 100 is formed of ribbed or castellated rubber for providing the desired amount of compliance. Such resilient mounting 100 somewhat reduces or snubs the flexing excursion of the back-up rollers 133 to a predetermined amount. The resilience of such mounting 100 may be obtained by means of grooves or castellated and bonded rubber sandwich pads, or by Belleville conical spring washers mounted on the mounting bolts for the bracket 99. The external rolling back-up wheels 98 so mounted may or may not touch the shafts 63 of the respective back-up rollers 133 when the machine is empty, depending on the particular application and the downstream position of the particular back-up roller 133.

If desired, in order to mitigate slightly the rigidity of the opposing convexly bowed rigid back-up rollers 34, slightly compliant spacers 101 may be mounted between the support members 50 and the rigid lower headers 38.

In order to assure that the positions of the rigid, convexly bowed back-up rollers 34 are accurately predetermined relative to the casting region C, the lower carriage frame 21 and the lower headers 38 and longitudinal stringer members 50 are constructed to be as rigid as practicable.

So far there has been described methods which involve predetermination of the desired bowability. Now there will be described methods which are adjustable at will, even being adjustable while the casting machine 10 is running.

METHODS FOR SHAPING THE CASTING PROVIDING ADJUSTABILITY

In order to elastically bend the flexible, bowable back-up rollers 133 for supplying adjustable forces toward the casting belts and hence toward the casting region C, approximately equal and opposite couple-forces are applied to non-rotating, lever-like, stub-shaft extensions 68 of the bowable back-up rollers 133 as shown in FIGS. 10 through 15 and 17 through 19.

Figure 12:
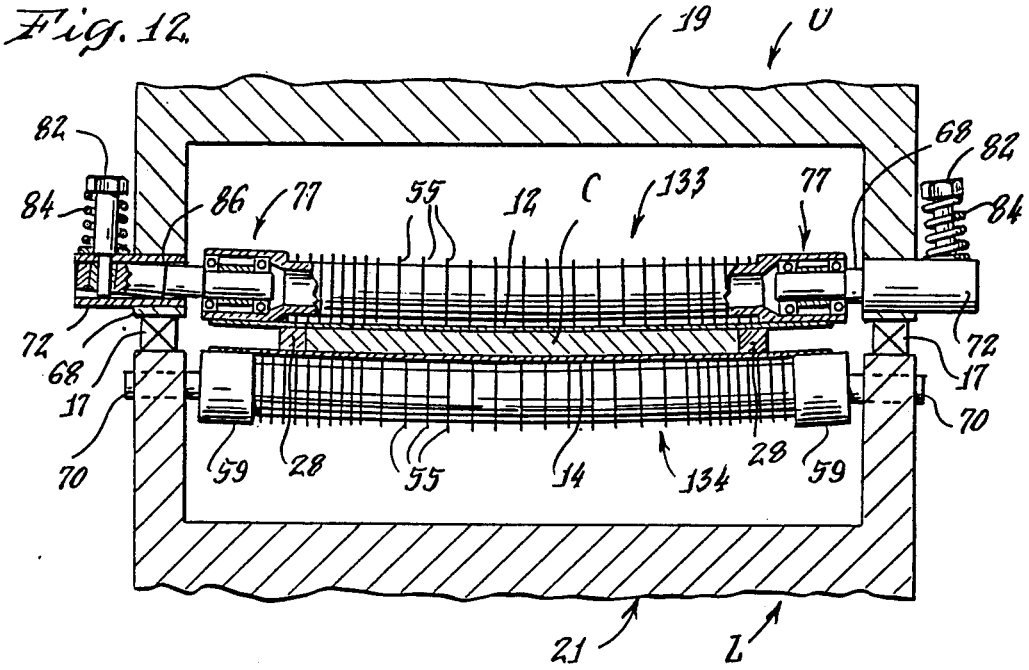
FIG. 12 is a transverse section similar to FIG. 11 in which the mechanical adjustment for the back-up rollers includes a compliance member.
Figure 12A:
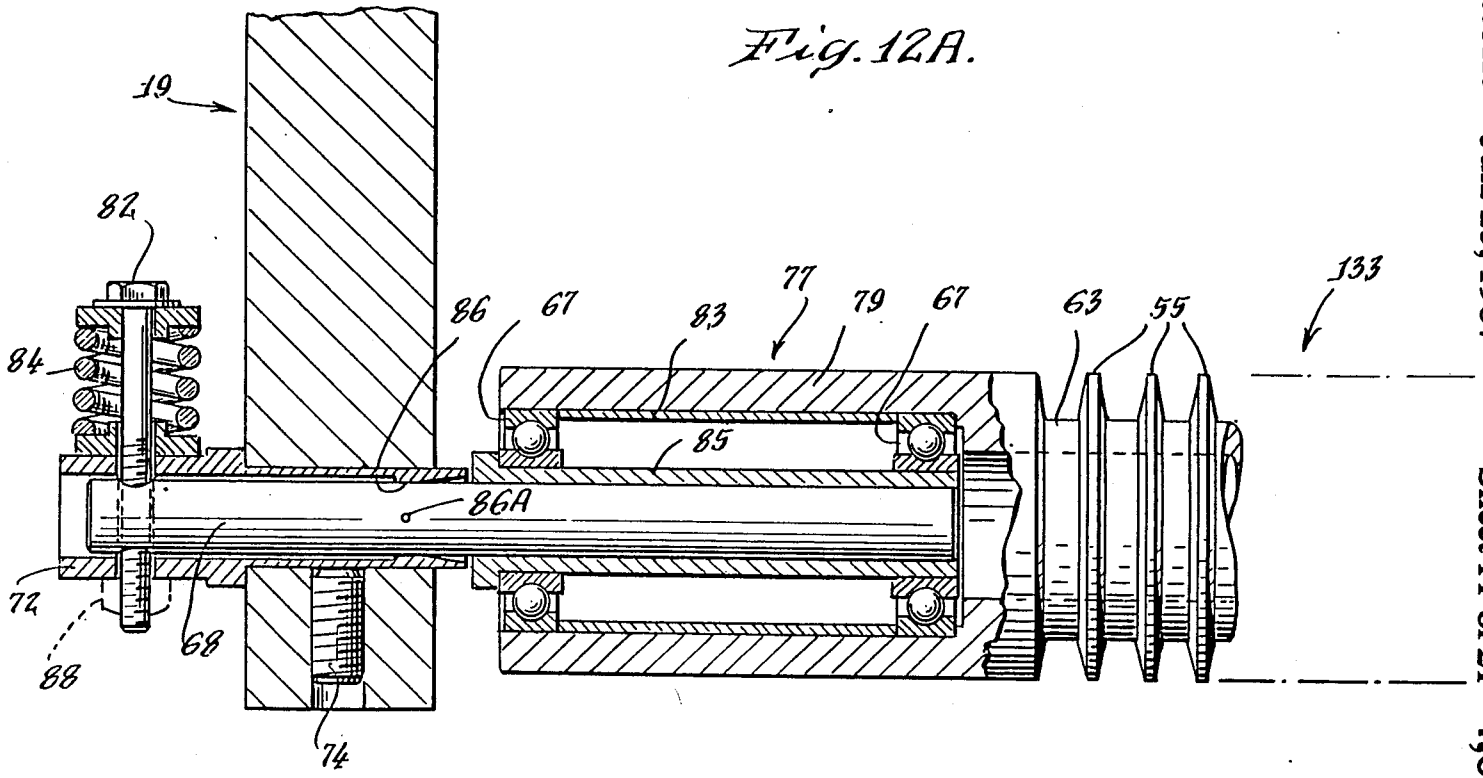
FIG. 12A is an enlargement.

As shown in FIG. 12A, the bowable back-up rollers 133 are connected to the stub-shaft extensions 68 by a pair of axially spaced anti-friction bearings 67 located in a bearing assembly 77 located within a large end portion 79 of the roller 133. The two bearings 67 are axially separated by a spacer sleeve 83 and are mounted upon an inner sleeve 85 on the stub-shaft extensions 68. The space between these sleeves 83 and 85 may be used to hold grease for the two bearings 67.

In order to provide an effective pivot point (i.e. a fulcrum) for the lever-like stub-shaft 68, there is a hardened steel collar or housing 72 seated in a drill hole in the respective carriage frame 19 (or 21 as the case may be) held by a set screw 74 and having an internal shoulder 86 which acts as a fulcrum for the stub-shaft lever 68. Therefore, adjustably moving the outer end of the stub-shaft lever 68 applies a couple-force (i.e. a bending moment) to the Although flexible back-up roller 133 for bowing it as desired. the fulcrum is actually located at 68, the effective pivot point may be considered to be located at 86A on the axis of the stub-shaft lever.

An approximately equal and opposite-sense couple-force (bending moment) is also applied to the opposite end of the flexible roller. By virtue of the couple-forces (bending moments) applied by the levers 68 to the ends of bowable roller 133 a constant moment is applied throughout the length of the roller; that is, if this roller 133 were otherwise free, its axis would be bowed into a circular arc. The stub shafts may alternatively be extended into shafts passing all the way through the roller, as shown in FIGS. 10 and 11.

Figure 10:
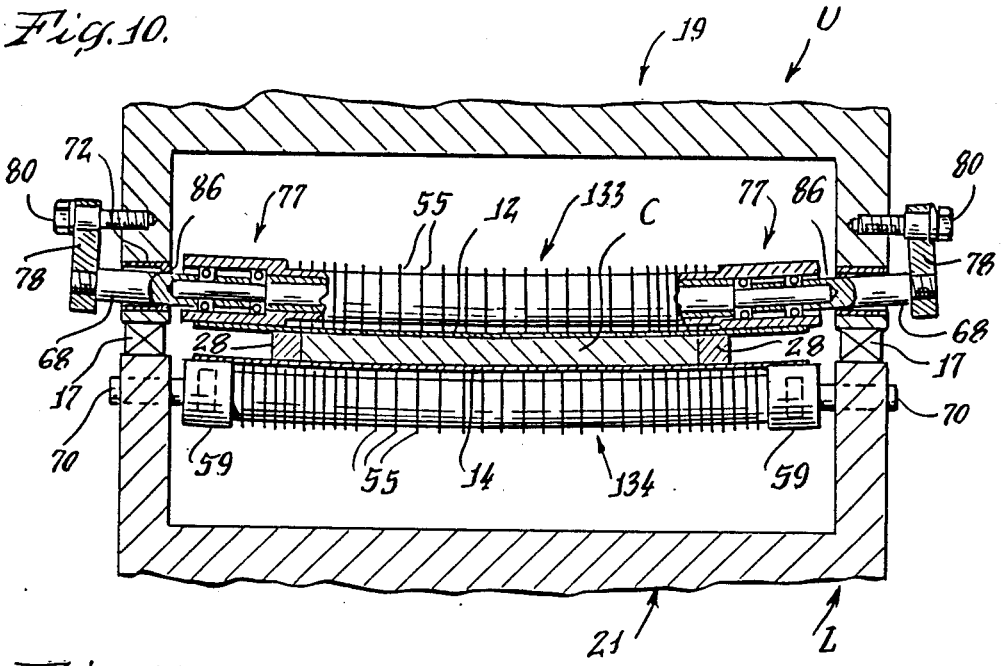
FIG. 10 is a transverse section of a twin-belt caster in which the belt shape and contact control is provided by transversely downwardly bowing the upper back-up rollers and by mechanical adjustment and allowing the lower back-up rollers to yield.
Figure 11:
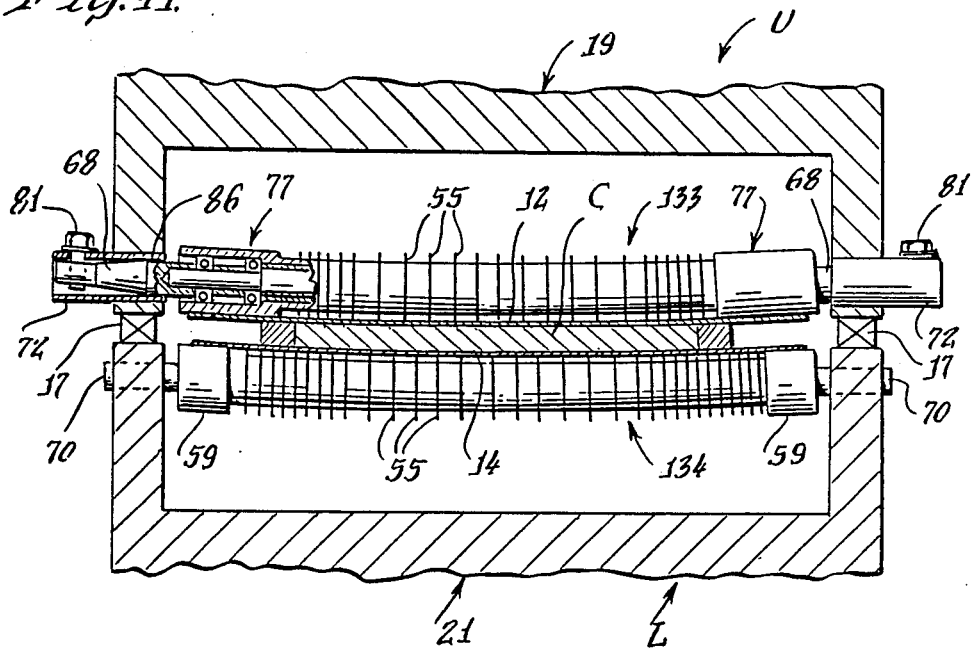
FIG. 11 is a transverse section of a twin-belt caster as illustrated in FIG. 10 showing another mechanical adjustment means.

As shown in FIG. 10 the stub-shaft levers 68 for the upper bowable back-up rollers 133 have actuating levers 78 connected to their outer ends. Each such actuating lever 78 is driven by adjustable means 80 shown as a horizontally positioned tightening machine screw which screws into a socket in the side of the machine frame 19. The stub-shaft lever 68 has a fulcrum 86 provided by a collar or housing 72.

The lower back-up rollers 134 are bowable, having self-aligning bearings 59 and fixed stub shafts 70. In the downstream portion of the casting region C where the metal in the casting region C is mostly all solidified, the flexible back-up rollers 134 conform to the thickness of the cast product. Therefore, the adjustment of the adjusting means 80 will tend to establish the arc of transverse curvature of the casting region C and will cause both belts 12 and 14 to hug the product for achieving good and uniform heat transfer over the areas of both top and bottom surfaces of the solidifying product.

In the upstream and central portions of the casting region C, where more of the metal is still molten, the "head" of the molten metal will cause predeterminable bending of the lower flexible rollers 134. The back-up-roller-bowing adjustment means 80 therefore are initially adjusted to provide a bow in each successive upper roller 133 which will correspond with the predetermined anticipated bow of the opposed lower roller 134. During operation of the casting machine the operator may then further adjust the adjusting means 80 if desired for further modifying the shape of the casting region C at the location of each adjustable back-up roller 133.

In the upstream and central portions of the casting region C the bowing of the adjustable roller 133 may, if desired, be made slightly less than the anticipated predetermined bowing of the lower rollers 134 for providing a transverse contour of the casting region C which is very slightly thicker near the middle as compared with the thickness of the margins near each edge dam 28. This slightly thicker middle then compensates for subsequent shrinkage of the middle of the cast product as it solidifies and cools below its freezing temperature.

The back-up roller bowing method of FIG. 11 is similar to that shown by FIG. 10, except that the fulcrum 86 is formed by the juncture of a conically tapered outer section of the stub-shaft lever 68 and a cylindrical inner section of this stub-shaft lever. Consequently, the hardened steel housing or collar 72 does not include an inner shoulder, and this housing or collar is extended out beyond the side of the frame 19. The adjusting means 81 is a vertically extending machine screw whose shank extends down through a hole in the wall of the cylindrical collar or housing 72. This adjusting screw 81 screws into a threaded hole in the outer end of the conical outer section of the stub-shaft lever 68. Thus, by tightening up on the two adjusting screws 81, the axis of the bowable back-up roll 133 is bowed convexly down toward the casting region C.

The back-up roller bowing method of FIGS. 12 and 12A is similar to that of FIG. 11, except that the adjusting means 82 is a longer screw than the screw 81, so that compliance means 84 is included in the adjustment. This compliance 84 is provided by a compression spring which surrounds the screw shank and is compressed between a washer beneath the head of screw 82 and a washer seated on the wall of the cylindrical housing or collar 72. The threaded lower end of the screw shank screws into a threaded hole in the outer end of the conical outer portion of the stub shaft lever 68. Among the advantages of including this compliance 84 which modifies the adjustment effect of the screw 82 are those resulting from the fact that a smaller gradiant of adjustment is afforded than with the direct (non-compliant) adjustment means shown in FIGS. 10 and 11. In other words, with the same screw thread pitch, a given amount of turning of the screw 82 will cause less bowing of the axis of the roller 133 than with the screws 81 or 80. The compliance of the springs 84 is predetermined to have a range comparable with the bowing compliance of the roller 133 as coupled through (reflected through) the stub-shaft levers 68 to the respective springs 84. At locations along the casting region where proportionately more bowing of the rollers 133 is desired, somewhat stiffer springs 84 may be employed.

Another advantage of using these compliant means 84 is that they will allow the casting belt 12 to deflect or yield for avoiding damage in case a prematurely solidified chunk of metal passes through the casting region C having a size greater than the spacing between the belts 12 and 14.

In FIG. 12 the fulcrum 86 is provided by the conical/cylindrical junction on the stub-shaft lever 68 In FIG. 12A this fulcrum 86 is provided by an internal shoulder in the collar or housing 72, as previously described. If desired, as shown in FIG. 12A, the threaded lower end of the shank of the screw 82 is extended down through a second hole in the wall of the housing or collar 72, so that an adjustable lock nut 88 may be used to prevent inadvertent "creep" of the adjusted position of the adjusting screw 82.

Figure 13:
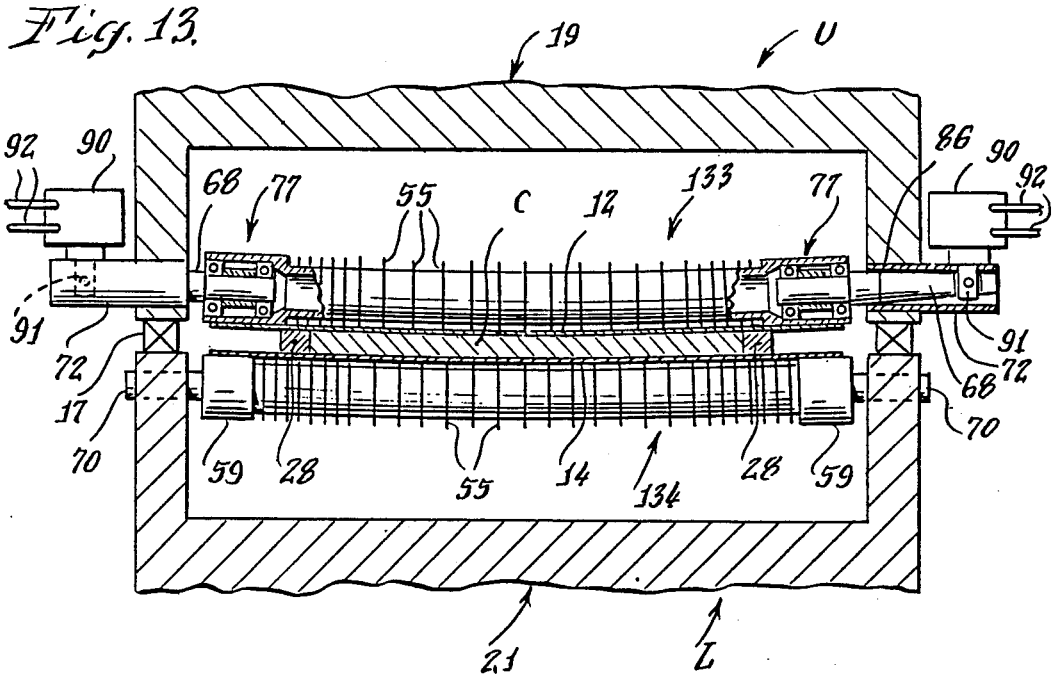
FIG. 13 is a transverse section of a twin-belt caster similar to FIGS. 10, 11 & 12 illustrating remote control bowing of the back-up rollers using fluid cylinder actuation.

As shown in FIG. 13, in order to provide remote control of the adjustment of the back-up roller bowing, there are fluid-actuated cylinder and piston units 90 whose piston rods 91 are pivotally connected to the respective outer ends of the stub-shaft levers 68. There are a pair of pipe lines 92 for fluid, connected to the upper and lower ends of the cylinder units 90 for operating the piston therein. Preferably these units 90 are hydraulic units; however, pneumatic cylinder and piston units 90 may be used, if desired.

The use of pneumatic units will inherently provide compliance by virtue of the compressibility of the compressed air in the cylinder 90. In order to provide compliance in the remote control system when hydraulic liquid is used as the actuating fluid, check valves are omitted from the pressure regulating valves, which are set at the desired pressure in the cylinder and piston units 90 corresponding to the predetermined desired bowing of the back-up rollers 133.

Actuation of these units 90 pulls upwardly on the piston rods 91, thereby controllably bowing the axis of the roller 133 convexly down toward the casting region C. A remote control console (not shown) is located near the operator's station including display meters providing a read-out of the pressure in the control units 90 for each bowable back-up roller. The console display meters may also be calibrated in thousandths of an inch or hundredths of a millimeter for indicating the controlled bowing cf the mid-point of the axis of each roller 133 away from a straight line. In other words, the pressure in each successive pair of units 90 for each successive bowable roller 133 along the casting region C can be independently controlled, and the resultant amount of deflection of each roller can be read on the read-out displays of the console.

Figure 14:
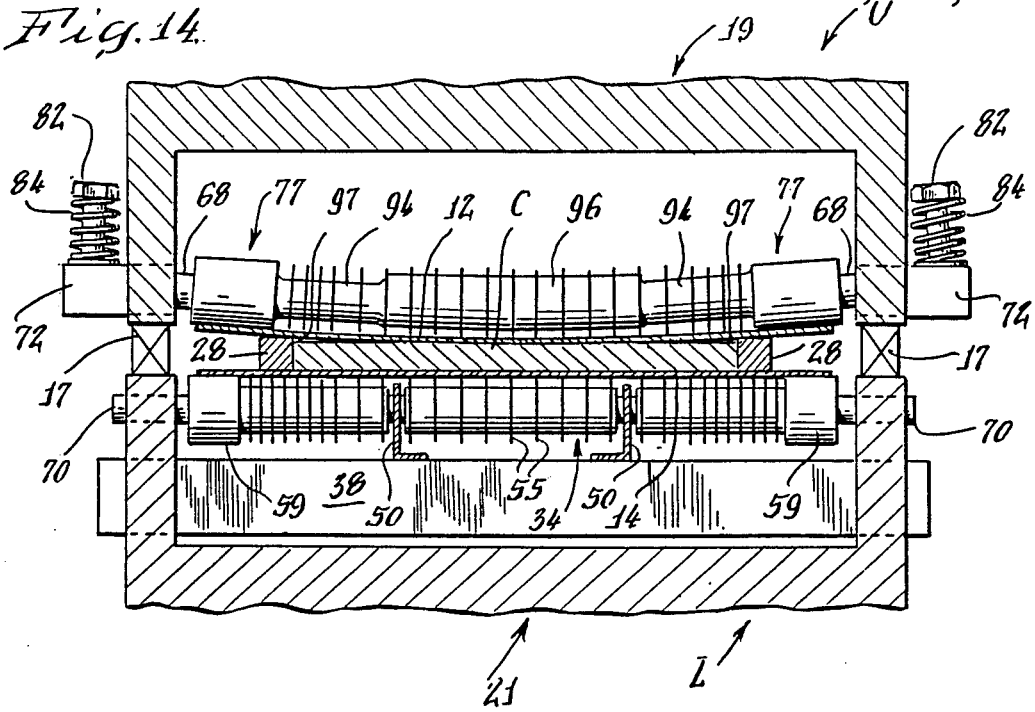
FIG. 14 is a transverse section of a twin-belt caster illustrating the use of rigidly supported lower back-up rollers with a stiffened center section in the bowed upper back-up rollers for control of belt contact with the product being cast.

The method for adjustably bowing the back-up rollers 133, as shown in FIG. 14, is similar to that shown in FIGS. 12 and 12A in that compliance springs 84 are associated with the adjustment screws 82 for bowing the flexible back-up rollers 133. The lower back-up rollers 34 are of rigid three-section construction with longitudinal stringer support members 50 mounted on rigid transverse frame members 38, for example, which may be the coolant headers as explained above. The upper back-up rollers 133 are being bowed convexly toward the casting region C.

In order to cause the axis of the bowed rollers 133 to have a flatter (longer radius) arcuate curvature opposite the middle of the casting region C for causing the upper belt 12 to hug the solidifying metal opposite the rigidly backed-up belt 14 which has a straight transverse shape, the diameter of the middle shaft portion 96 of the hollow bowable roll shaft is made larger than the end shaft portions 94. The diameter of the bore of this hollow roller 133 is uniform. Therefore, the wall thickness of the middle shaft portion 96 is proportionate ly increased more than the difference in the outside diameter of the middle shaft portion 96 as compared with the outside diameter of the end shaft portions 94. (It is noted that the stiffness of a length of round solid shaft in bending varies as the fourth power of its diameter.) Consequently, the stiffness of the hollow middle portion 96 in bending varies as a higher power function of its outside diameter than in the case of a solid shaft As a result, relatively small increases in outside diameter of the middle portion 96 of this hollow shaft will provide relatively large increases in stiffness as compared with the hollow end portions 94.

Figure 15:
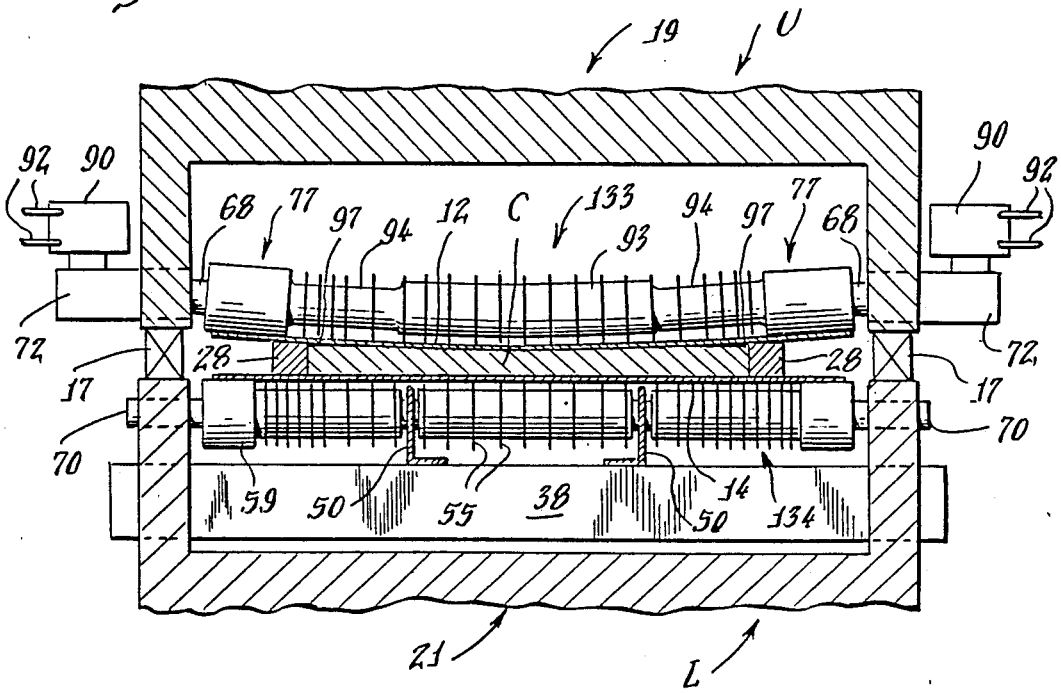
FIG. 15 is a transverse section of the caster of FIG. 14 illustrating the use of remote control for belt contact control.

It is to be understood that the differences in diameter at 96 and 94, as shown in this FIGURE and in FIG. 15, are exaggerated for purposes of illustration, and the bowing of the roller 133 is also exaggerated. The solidifying product in the casting region C is shown in FIGS. 14 and 15 as having shrunk slightly relative to the height of the edge dams 28. (Not only is the cast product cooling and shrinking, but the solid metal blocks in the edge dam 28 are becoming heated and are expanding.) This shrinkage relative to the expanding edge dams 28 is indicated exaggerated at the upper surface of the margins of the cast product at 97. The objective of the more flexible end shaft portions 94 is to bow the back-up roller 133 downwardly for causing the upper belt 12 to hug the shrinking cast product as close to the edge dams 28 as possible.

The method for bowing the back-up rollers 133 in FIG. 15 is similar to that described above in FIG. 14, except that remotely controllable fluid-actuated cylinder and piston units 90 all employed, thereby providing similar operating and control advantages as explained in connection with FIG. 13.

Figure 16:
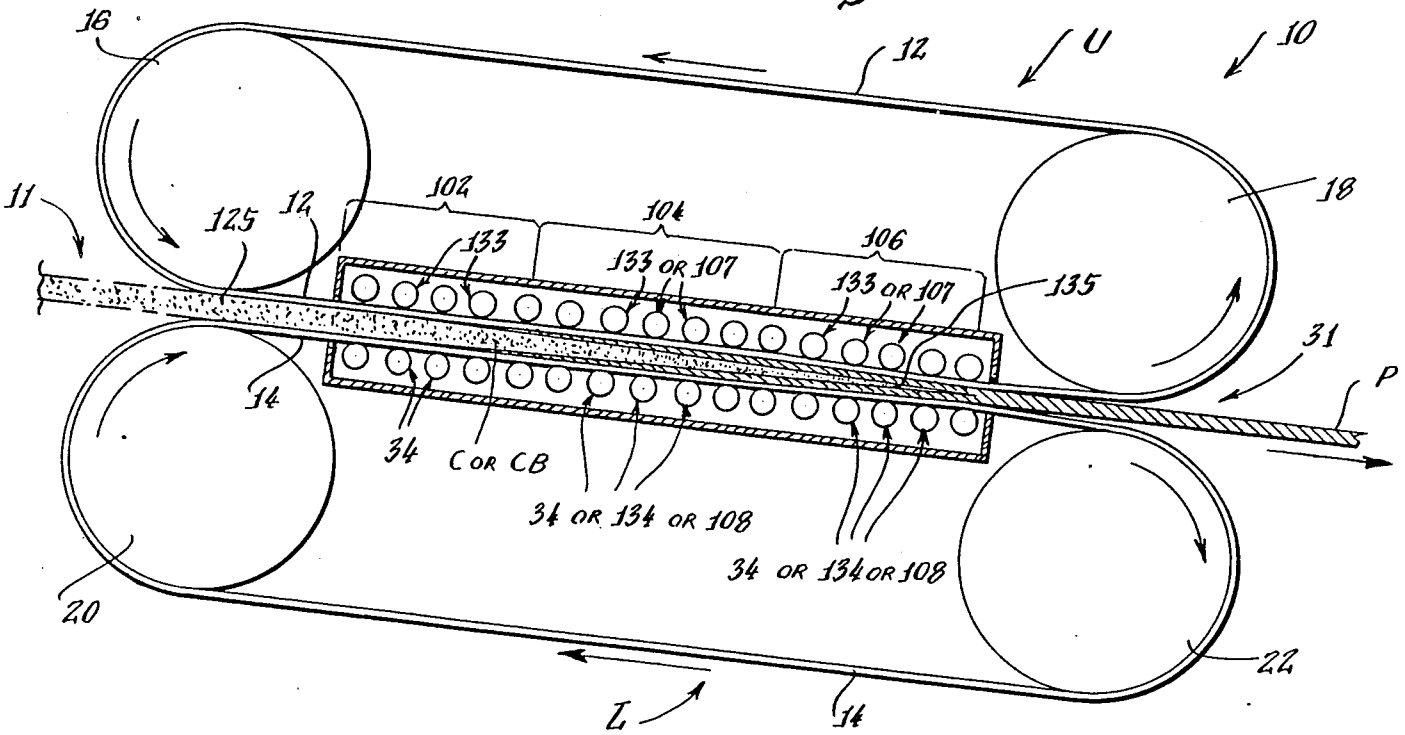
FIG. 16 is a longitudinal, elevational section of the casting region illustrating the use of a selectively tapered mold configuration along the casting region.
Figure 19:
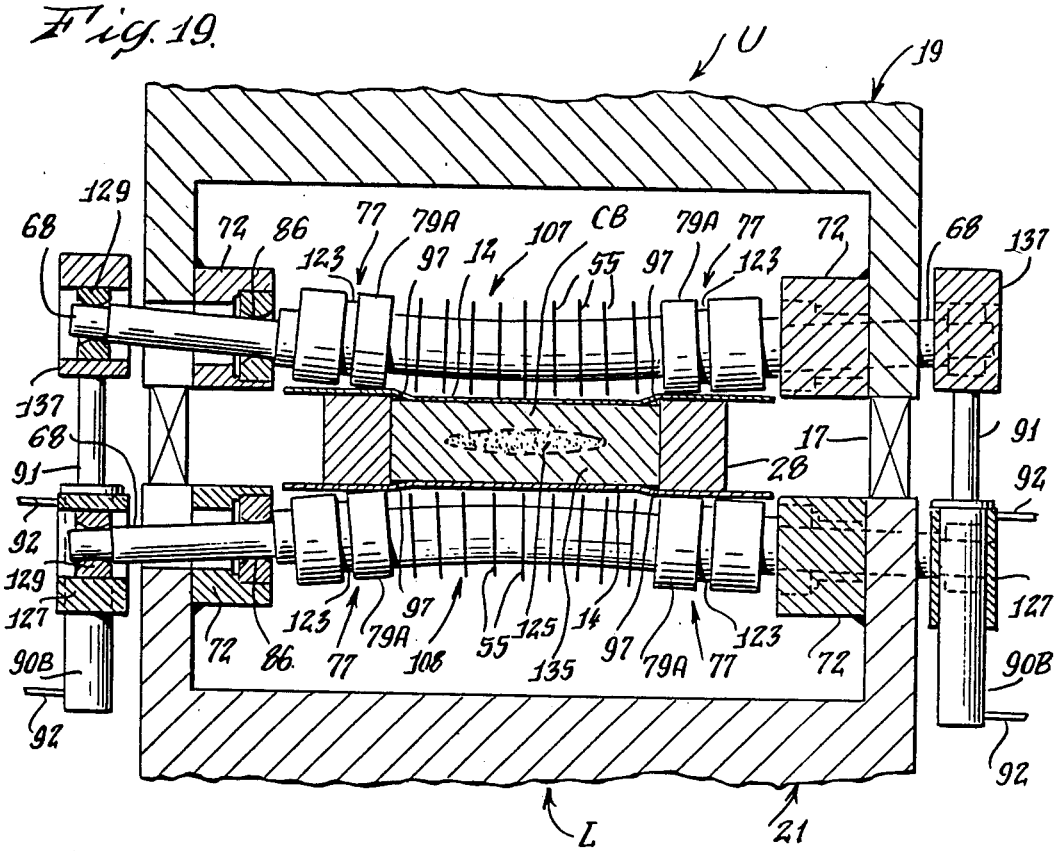
FIG. 19 is a transverse section of the bar caster shown in FIG. 18 after shrinkage has occurred, illustrating piston rod actuation for bending the back-up rollers to maintain belt contact in the downstream portion of the casting region.

In FIG. 16 the casting region is shown selectively tapered toward the downstream or exit end 31. The casting region is labelled "C or CB" for indicating that this casting region may be relatively wide as illustrated in FIGS. 6, 9–15, 17, 20–24 or may be relatively narrower and higher for casting a bar product as illustrated in FIGS. 18 and 19. The molten (liquid metal is indicated dotted at 125, and the solidified (frozen) metal is indicated by diagonal cross-hatching lines at 135. The cast product P travels away from the caster exit 31 carried by appropriate conveyor means (not shown), and secondary cooling means (not shown) are often employed for further cooling of the cast product P as immediately as possible after exiting from the caster.

It is to be noted that the molten interior region 125 of the solidifying product 135 continues downstream along a considerable distance approaching toward or even extending beyond the exit 31. This molten interior 125 may be called the molten or "liquid core" or "liquid sump". Generally speaking, for a given thickness of cast product P, the faster the caster 10 is running, the further downstream extends the interior liquid sump 125. In practically every case where the liquid sump 125 extends downstream beyond the exit 31 secondary cooling is employed.

The casting region C or CB is shown longitudinally divided into an upstream portion or zone 102, a central portion or zone 104, and a downstream portion or zone 106. In this upstream portion or zone 102, the rigid back-up rollers 34 and the flexible back-up rollers 133 hold the casting belts 12 and 14 generally parallel. In this upstream portion 102, very slight excess (or bulging) in thickness (as seen in transverse section) may be provided in the major central transverse area of the casting region C or CB (i.e. the transverse contour of the casting region C or CB may be very slightly thicker over the major central portion of its area) as compared with the margins, because the margins of the cast metal 135 adjacent to the edge dams tend to solidify and cool more quickly than the major central area of the cast metal for thereby compensating for the subsequent shrinkage in this major central area (as seen in transverse section).

In the longitudinal central portion or zone 104 of the casting region C or CB the belts 12 and 14 begin to converge slightly downstream, i.e. the mold space is tapered by the rigid lower back-up rollers 34 or flexible lower back-up rollers 134 or 108 (FIG. 18) in cooperative action in opposition to the flexible upper rollers 133 or 107 (FIG. 18).

The flexible back-up rollers may be bowed, adjusted and controlled in their belt contour configuration in the respective zones 102, 104 and 106 by any one or more (singly or jointly) of the various methods as described above, or as described hereinafter. The longitudinal taper through the various zones 102, 104, 106 may be varied and may be utilized for achieving various transverse contours as desired for causing both belts to hug the solidifying metal 135 and for producing a cast product P of the desired dimensions and desired uniform metallurgical properties.

In the longitudinal downstream portion or zone 106 of the casting region C or CB, the belts 12 and 14 converge with an increased taper as compared with the zone 104 as achieved by the rigid lower rollers 34 or flexible lower rollers 134 or 108 (FIG. 18) in cooperative action in opposition to the flexible upper rollers 133 or 107 (FIG. 18).

The "head" pressure effect against the belts may be greatest in the zone 104 or in the zone 106 depending upon such factors as the amount of solidified metal 135 as compared with liquid sump 125, speed of the caster 10, density (weight per unit volume) of the molten metal 125, overall thickness of the product P.

If desired, the downstream taper of the longitudinal zones 104 and 106 may be accomplished in part by causing the upper carriage U to converge downstream slightly toward the lower carriage by using compliant gauge spacers 121 (FIG. 26) or 128 (FIG. 27) between the side members of the carriage frames 19 and 21 near the exit end 31 in lieu of the rigid gauge spacers 17 (FIG. 1). Thus, rigid gauge spacers 17 are used near the upstream end 11 and compliant ones 121 or 128 (FIGS. 26 or 27) are used near the downstream end 31. Therefore, the downstream end of the upper carriage U may be caused to "float" somewhat upon the "head" pressure of the liquid sump 125 acting the area of the upper belt.

Figure 17:
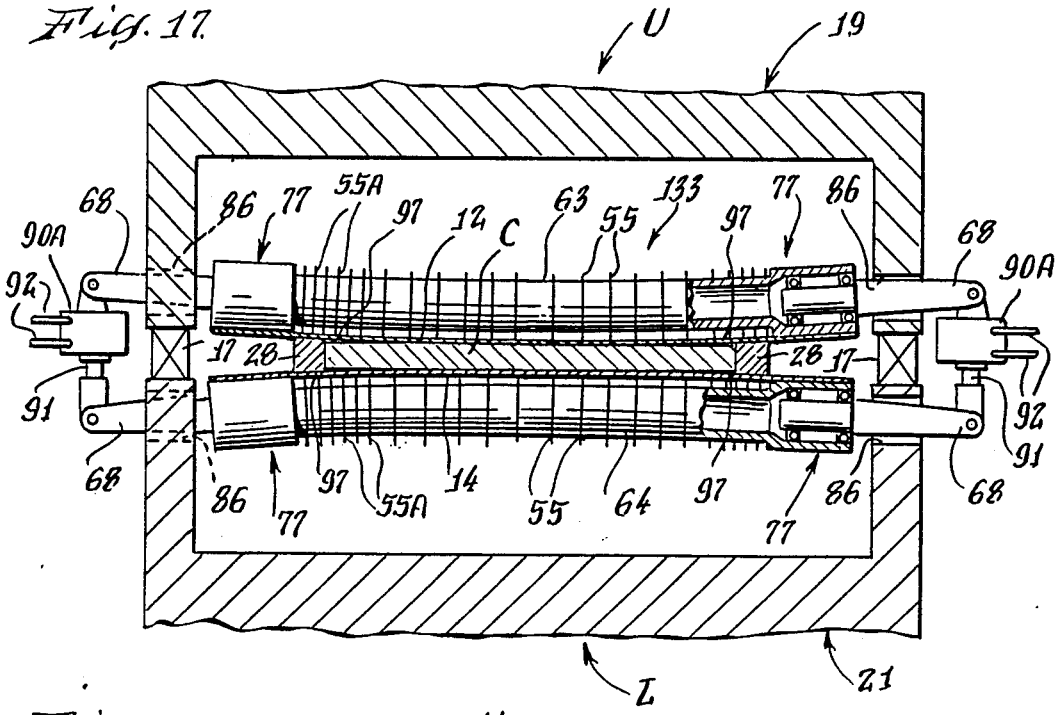
FIG. 17 is a transverse section of a twin-belt caster employing symmetrical inward bowing on both the upper and lower back-up rollers by remote control through fluid cylinder actuation.
Figure 18:
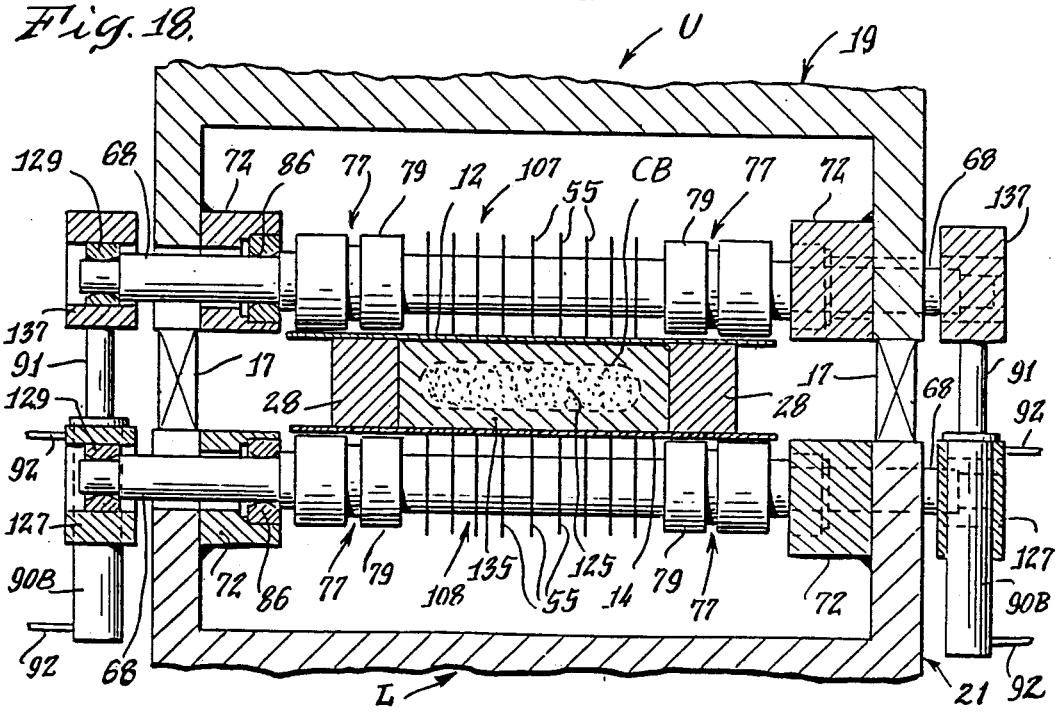
FIG. 18 is a transverse section of a bar-type twin-belt caster illustrating the casting zone before shrinkage of the product being cast.

In FIG. 17 the remotely controllable fluid-actuated cylinder and piston units 90A are connected between the stub-shaft levers 68 for applying essentially equal and opposite force-couples (bending moments) to the respective opposed bowable lower and upper rollers 134 and 133. The piston rods 91 are detachably pivotally connected to the respective lower stub-shaft levers 68.

The circumferential ridges or fins 55 are shown more closely spaced at 55A (FIG. 17) near the margins of the casting region C, thereby providing the operator with the option of positioning the edge dams 28 closer together. It is desired that the fins 55A be relatively close together for firm back-up of the respective belts where the edge dams are located.

Figure 17A:
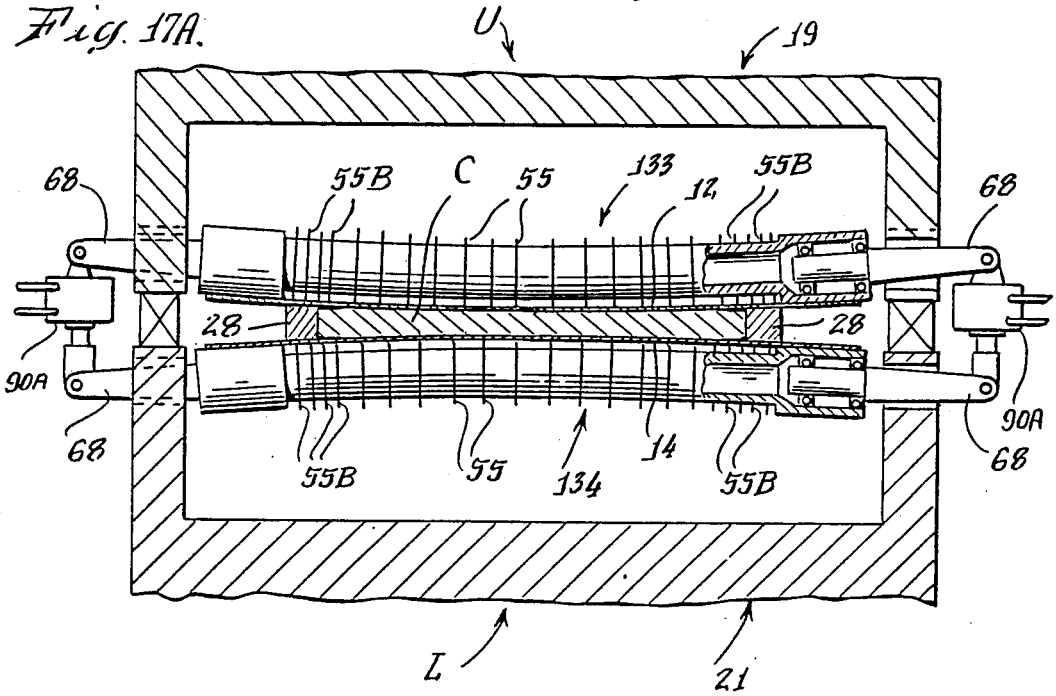
FIG. 17A is a modification of the method of FIG. 17.

In the modification shown in FIG. 17A, the closely spaced fins 55B opposite the edge dams 28 have a reduced diameter as compared with the other fins 55 on the same back-up roller opposite the casting region C. These reduced diameter fins 55B allow the larger fins 55 to push the respective belts 12 and 14 inwardly for causing the belts to hug the solidifying shrinking metal at the margins 97 as close to the edge dams as possible.

This reduced diameter fin modification of FIG. 17A can be used to advantage in the zone 106 (FIG. 16) and may be used in the zone 104 (FIG. 16) if desired. This reduced diameter fin modification can be used to advantage in conjunction with the increased flexibility of roller end sections 94 (FIGS. 14 and 15).

FIGS. 18 and 19 show the casting of a bar product and so the casting region is labeled "CB." The internal liquid sump 125 is shown, and this liquid sump is smaller in FIG. 19, because FIG. 19 is a section taken farther downstream than FIG. 18. The edge dams 28 are shown higher than in previous FIGURES, because a bar product is cast relatively thicker.

In order to compensate for the shrinkage 97 of the solidified metal (FIG. 19) the large end portions 79A (FIG. 19) of the upper and lower bowable back-up rollers 107 and 108 are made smaller in diameter than the normal-sized fins 55. (These large end portions 79A may include one or more grooves 123 for allowing coolant to flow along the belt.) The resulting belt clearance spaces at the edge dams permit the fins 55 to deflect the belts slightly to hug the shrinking product very effectively for minimizing any shrinkage gap 97 at the margins adjacent to the edge dams 28. Indeed, such reduced-diameter techniques of relief effectively permit roller-bending or taper to be used downstream.

In FIG. 18 the large end portions 79 are shown to have the same diameter as the fins 55.

For providing the fulcrums 86, the shaft housings 72 project inwardly from the side members of the respective carriage frames 19 and 21 and include internal shoulders formed by hardened steel ring inserts.

The remotely controllable fluid-actuated cylinder and piston units 90B for bowing the rollers 107 and 108 are pairs of cylinders located on opposite sides of the lower stub-shaft levers 68. In other words, this pair of cylinders straddles the lever 68. These pairs of cylinders are mechanically interconnected by a yoke structure 127 havingt a hardened steel ring insert 129 forming the outer pivot fulcrum for the lower stub-shaft lever 68. The pairs of piston rods 91 are also interconnected by a yoke structure 137 having a similar ring insert forming the outer pivot fulcrum for the upper stub-shaft lever 68. The advantage of straddling the stub-shaft lever 68 is that longer cylinder units 90B can be employed more conveniently for a greater range of cast thicknesses. The advantage of the modified design with its greater leverage and heavier parts is that it permits more effective roller-bending for narrow cast products. Equal and essentially opposite force-couples (bending moments) are advantageously being applied to both the upper and lower rollers 107 and 108 for achieving symmetrical upper and lower belt contours.

In the embodiments described above, the belt shape and contact control has been primarily accomplished by directly bowing flexible back-up rollers 133, 134, 107, 108 in various ways. Another system which is shown in FIG. 20 involves the elastic bending of a relatively rigid structural frame member 112 having relatively rigid back-up rollers 33 mounted thereto by the stringer members 52, so that these segmented rollers 33 also will be caused to assume an overall arcuate configuration.

Figure 20:
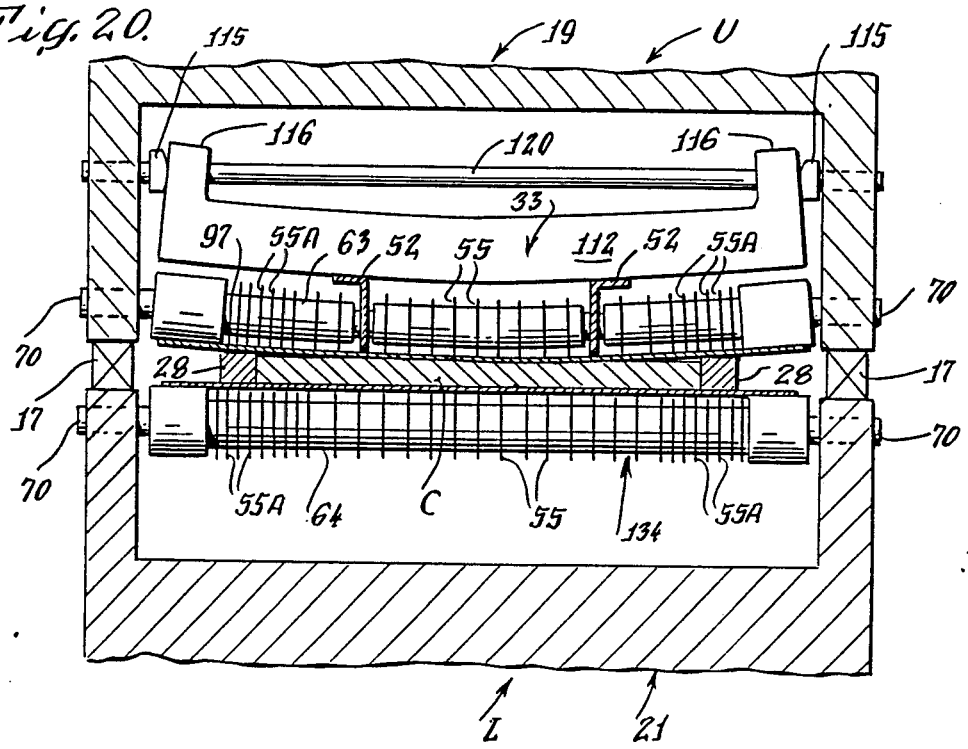
FIG. 20 is a transverse section of a wide caster illustrating the bending of a structural frame member in order to bow the back-up roller supported by such frame member.

In FIG. 20, the transverse frame member 112, which for example may be a header or other frame member, is stiffly bowable. It has upstanding arms 116 at either end. A transverse rod 120 is mounted in the frame 19 of the upper carriage U having tightening nuts 115 on threaded end regions of this rod. In this embodiment by tightening the nuts 115, the frame member 112 is bowed and since the back-up rollers 33 are slaved to this frame member, the back-up rollers 33 also bow a corresponding amount. The lower back-up rollers 134 are bowable under the pressure of the metal "head".

Figure 21:
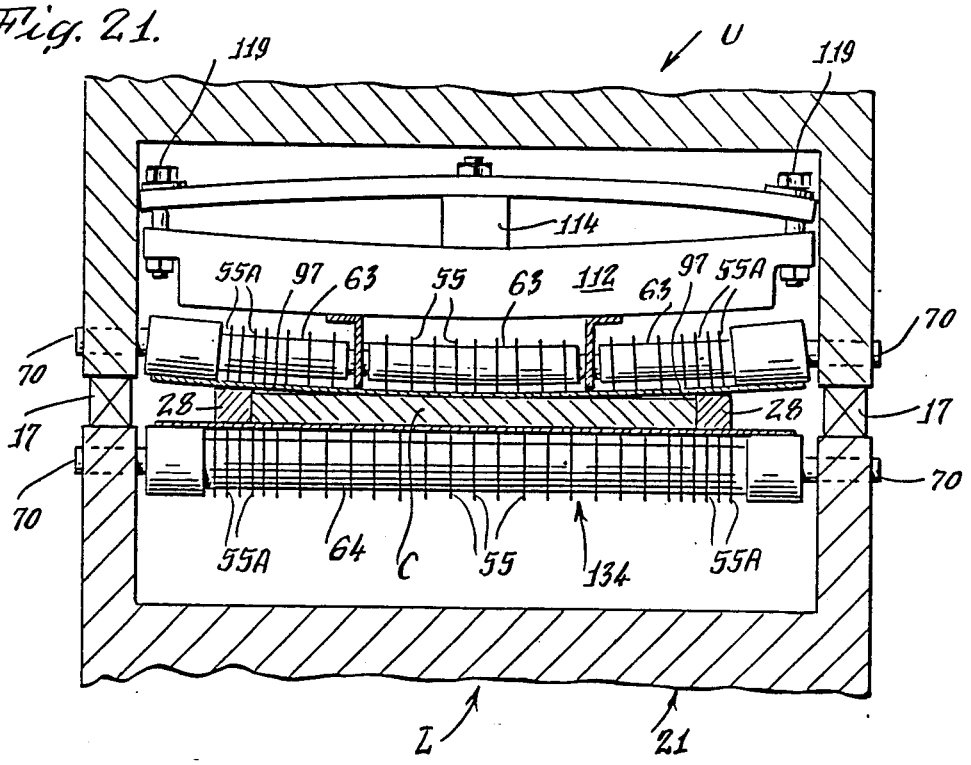
FIG. 21 is a transverse section of a wide caster similar to FIG. 20 utilizing a more bendable (compliant) member in order to bow a stiffer frame member in order to provide a finer (more precise) bowing adjustment of such frame member.

In FIG. 21, which is similar to FIG. 20, a transverse member is positioned generally parallel with the stiffly flexible frame member 112. This second member 110 is more flixible than the first member 112, for example, it is a bowable leaf spring member. This second member 110 is attached by bolts 119 to the ends of the first member 112 with a center spacer or block 114 positioned therebetween. By tightening the bolts 119 at the ends of the bowable leaf spring member, the first member 112 is bowed as is the segmented upper back-up roller 63 which is rigidly attached to the latter by the stringer members 52. By utilizing this second member 110, which has more flexiblity than the first member 112, a finer, more determinate, vernier bowing adjustment can be made of the transverse frame member 112 and hence more determinate bowing of the configuration of the back-up roller 63.

Figure 22:
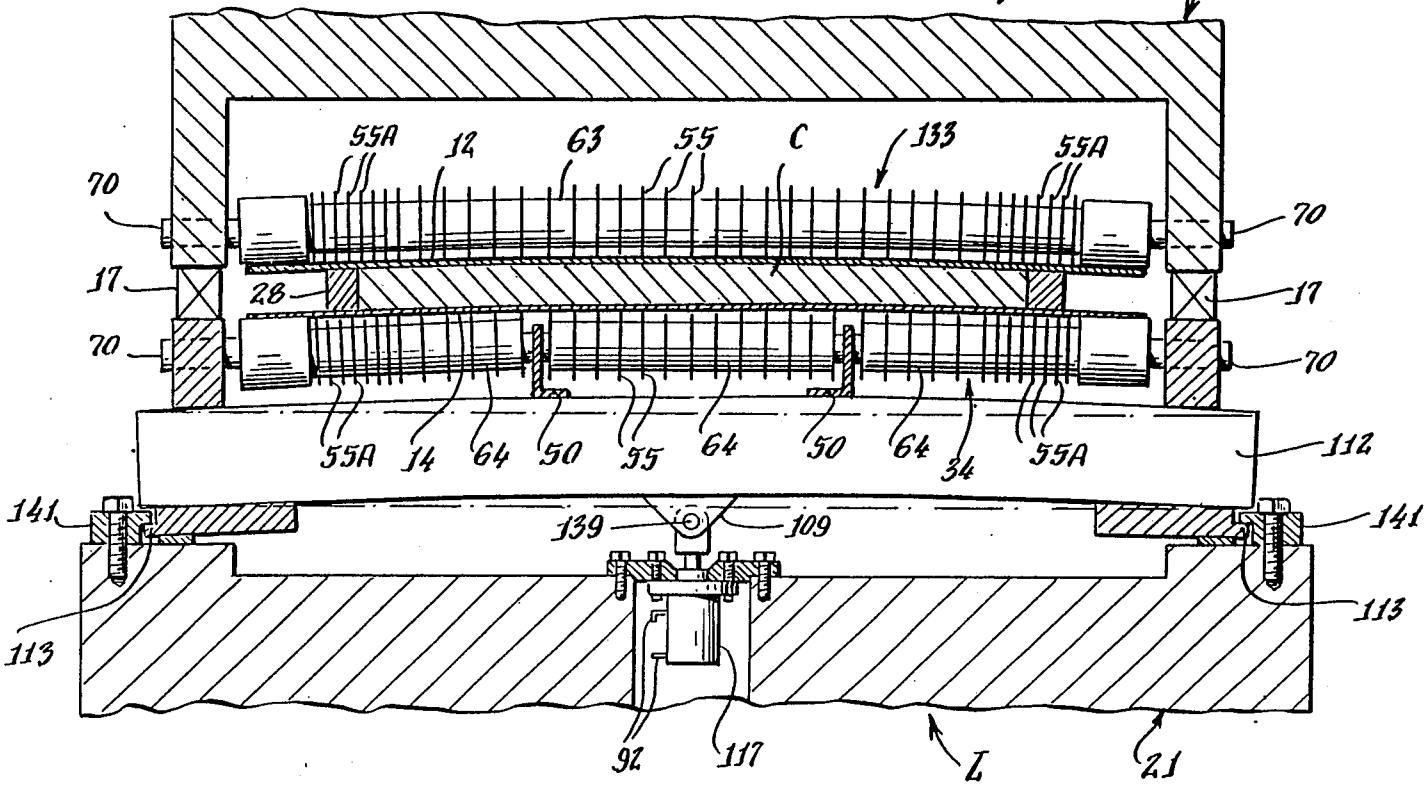
FIG. 22 is a transverse section of a wide caster illustrating the bending of a lower frame member by a remotely actuable fluid cylinder connected to the center of the frame member.

In FIG. 22 a remotely controllable fluid-actuated cylinder and piston unit 117 is pivotally connected at 139 to a bracket 109 mounted centrally on a lower stiffly flexible transverse frame member 112, for example, which may or may not be a coolant header. Thus, a remotely controllable bending moment is applied for bowing this transverse frame member 112 whose ends are captured by flanges at 113 and retainers 141 bolted to the lower frame 21. Accordingly, as the member 112 is bowed, the segmented, rigidly mounted back-up roller 34 is correspondingly bowed to urge the lower belt 14 against the cast metal. The upper back-up roller 133 is bowable, so that the upper belt 12 stays in contact with the top surface of the cast metal.

Figure 23:
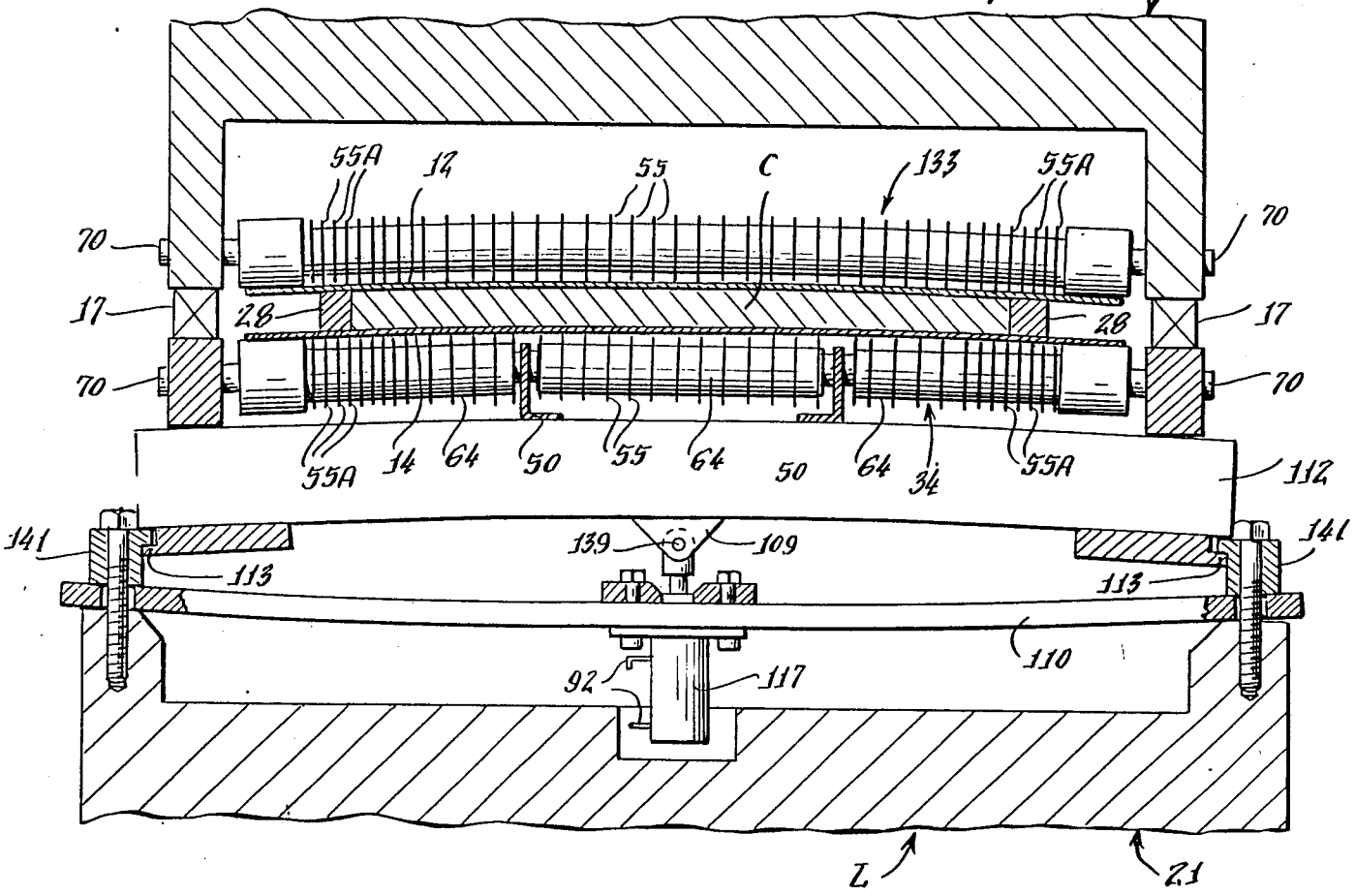
FIG. 23 is a transverse section of a wide caster illustrating the bowing of a structural frame member in the lower carriage using a more compliant member and a remotely actuatable-fluid cylinder connected to the center of the compliant member.
Figure 24:
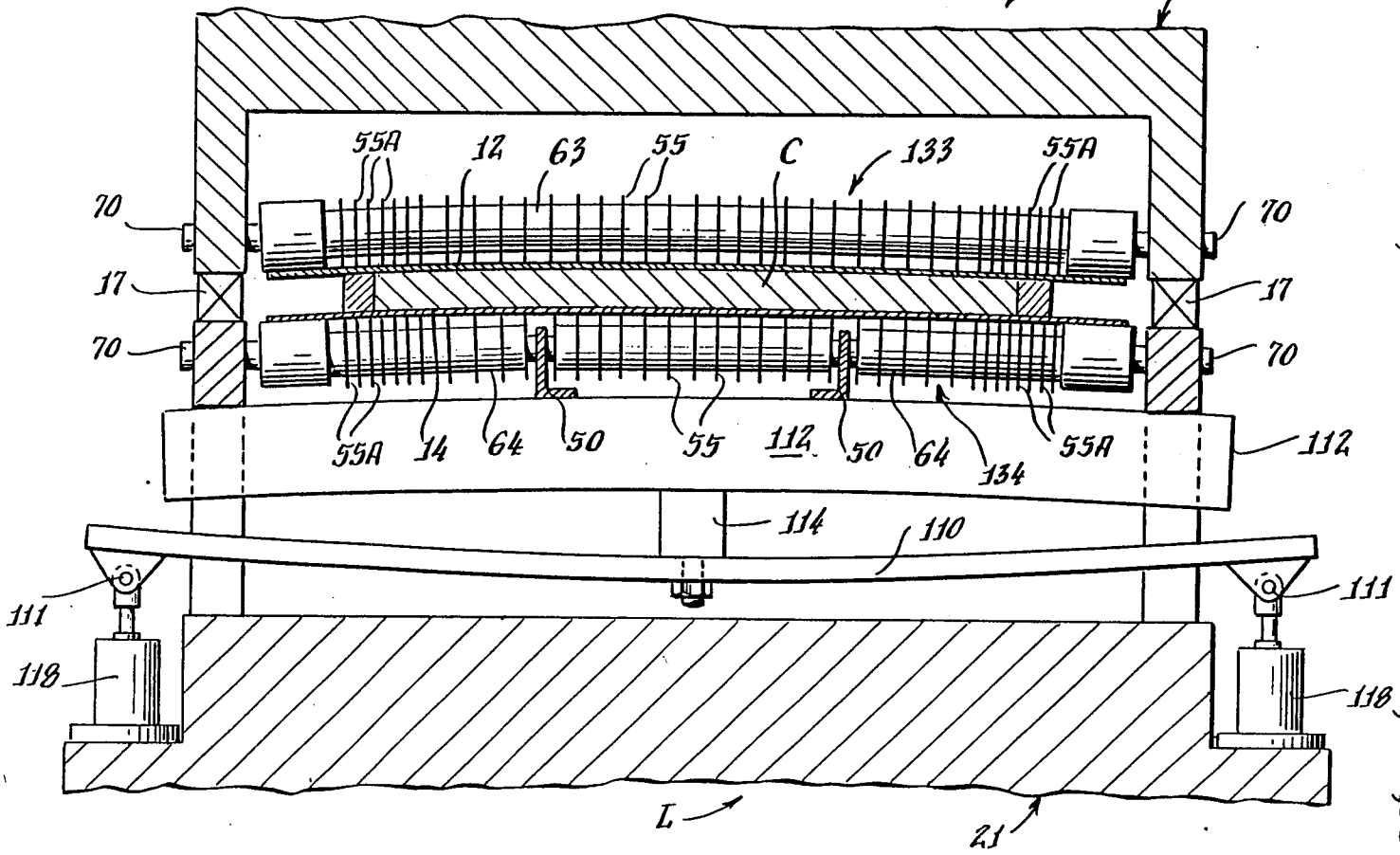
FIG. 24 shows the use of a more compliant member for bending a stiffer member, with two actuatable fluid cylinders located at the respective ends of this compliant member.
Figure 25:
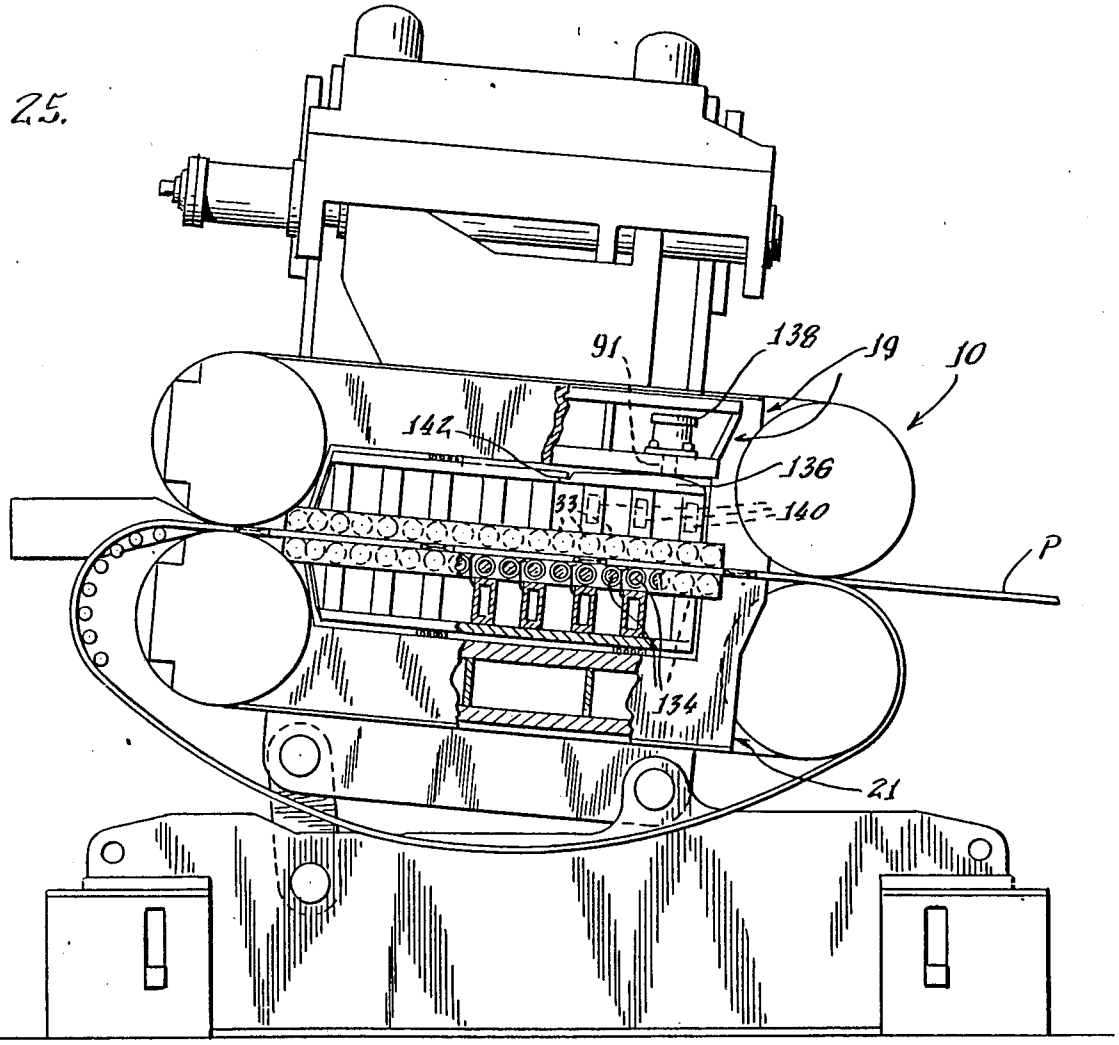
FIG. 25 shows the progressive tapering of the downstream portion of casting region by means of a fulcrumed lever driven by a fluid-actuated cylinder for simultaneously bowing a plurality of transverse frame members, each one slightly more than the preceding one.

In the embodiment illustrated in FIG. 23 a combination of the transverse frame bowing methods and systems utilized in FIGS. 21 and 22 is employed. Accordingly, the upper back-up roller 133 is bowable. The lower segmented back-up roller 34 which is rigidly mounted to the lower frame member 112 is also bowed by actuating the centrally located cylinder unit 117 which is secured by mounting means 143, for example bolts, upon a second, generally parallel, more flexible transverse member 110, for example, a leaf spring member, whose ends are also captured by the retainers 141. In effect the remotely controllable unit 117 is drawing a bow by pushing up on the stiffly flexible member 112 while pulling down upon the relatively more flexible second member 110. Therefore, the remotely controllable unit 117 in FIG. 23 provides an accurately determinate bowing of the first frame member 112 for precisely controlling the configuration of the roller 34 which is rigidly slaved to the member 112.

FIG<24 shows a method and system for controllably bowing rollers 34 generally similar to FIG. 23, except that a pair of remotely-ontrollable fluid-actuated units 118 mounted on the lower carriage frame 21 are pivotally connected at 111 to the respective ends of the second member 110. A spacer block 114 is located between the central regions of the first and second members 112 and 110, respectively.

In order to simultaneously bow a plurality of transverse frame members 140, for example, headers, there is a longitudinally positioned rocker arm 136 whose upstream end is effectively pivoted at 142 by a fulcrum connection to the frame 19 of the upper carriage U. A remotely controllable fluid-actuated cylinder and piston unit 138 is secured to the frame 19 in the vicinity of the downstream end of this rocker arm 136. The rocker arm 136 and the cylinder unit 138 are located midway between the inboard and outboard sides of the upper carriage U. Its piston rod 91 urges the downstream end of this rocker arm 136 for bowing the transverse frame members 140 convex down toward the casting region for producing a corresponding convex down configuration of the upper back-up rollers 33 which are slaved to the respective transverse frame members 140. The opposed lower back-up rollers 134 are bowable.

Each successive transverse frame member 140 is bowed slightly more than its upstream member, because each successive frame member 140 is being acted upon by the rocker arm 136 further downstream from its pivot fulcrum. Thus, a remotely controllable taper of the casting region C is advantageously provided by actuating the unit 138 acting through the rocker arm 136.

The compliant gauge spacer 121 (FIG. 26) includes a head 122, a locating pin 124 which engages in a socket 144 in the side frame member of the lower carriage 21. This locating pin 124 is screwed into the head 122 with a plurality of Belleville washers (conical spring washers) 126 on the shank of this pin. These spring washers are captured by a shoulder 146 on the locating pin 124. The lower surface of the head 122 has a concave conical shape 148 with a pitch or slope which is more shallow than the pitch or slope of these spring washers when they are in their unloaded (relaxed) condition, and thus there is a gap 131 for permitting compliant deflection of these spring washers up to a limit when this gap 131 is closed. Hence, the slope of concave surface 148 acts as a stop for limiting the deflection of these spring washers to a predetermined limit.

The compliant gauge spacer 128 (FIG. 27) has a head 122 and a locating pin 124 inserted into a socket 144. The locating pin 124 is fastened by a small diameter stud 130 passing through a small diameter hole 150. A stiffly flexible leaf spring 152 is thereby captured on the stud 130. The deflection of this leaf spring 152 is limited by the gap at 132. A retainer pin 154 seated in a socket in the side frame 21 engages in a notch 156 for holding this leaf spring in longitudinal alignment with this side frame.

It is to be noted that the bearing assemblies 77 (FIG. 12A) can be inverted (turned inside out) by using hollow cylindrical stub shafts which encircle the bearings 67 which, in turn, encircle the end of the roller shaft 63.

Figure 9:
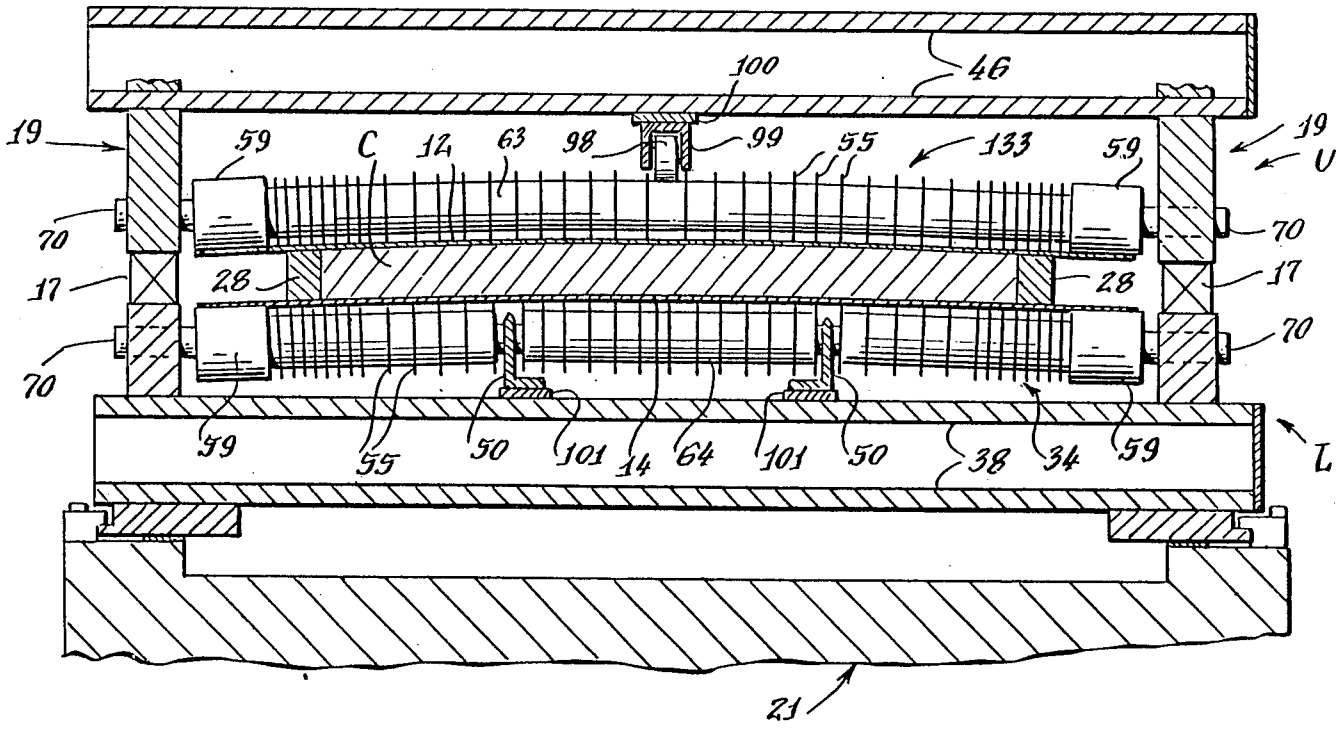
FIG. 9 is a view similar to FIG. 6 showing intermediate, flexible snubbing bearing back-up means for the flexible back-up roller for providing predetermined control of its degree of flexibility.

Also, it is to be noted that in FIGS. 6, 8 and 9, the transverse members 38 and 46 can be other members than headers.

Since other changes and modifications, varied to fit particular operating and casting requirements and environments, will be understood by those skilled in the art, the invention is not considered limited to the examples chosen for purposes of illustration, and its scope includes all changes and modifications which do not constitute a departure from the true spirit and scope of this invention as claimed in the following claims and reasonable equivalents to the claimed steps.

We claim:

1. In the method of continuously casting metal product directly from molten metal in which the molten metal is confined and solidified in a casting region defined above and below by upper and lower cooled endless, flexible, traveling, casting belts supported by a plurality of upper back-up rollers and a plurality of lower back-up rollers in respective upper and lower belt carriages and laterally defined by first and second traveling side dams, the method comprising the step of:

providing bowable back-up rollers, selectively bowing at least some of said back-up rollers in predetermined amounts along portions of said casting region for maintaining the upper and lower belts in contact with the molten metal as it is progressively solidified in passing through the casting region.

2. In the method of continuously casting metal product as claimed in claim 1, the further steps comprising:

predetermining the "head" of the molten metal at various longitudinal positions along a downwardly inclined casting region, predetermining the resultant concave bowing deflection of the bowable back-up rollers in a first carriage, and causing relatively rigidly supported back-up rollers in the second carriage each to assume a convex contour toward the casting region corresponding to the predetermined concave contour of the respective opposite concavely bowed back-up roller for producing a cast product having slight transverse curvature and of uniform thickness across its transverse section.

3. In the method of continuously casting metal product as claimed in claim 1 or 2, the further step comprising:

mounting at least one snubbing roller in said first carriage near to a bowable portion of at least one bowable back-up roller for engaging said bowable portion for modifying its bowing characteristics.

4. In the method of continuously casting metal product as claimed in claim 3, the further step comprising:

resiliently mounting said snubbing means in said first carriage for further modifying the bowable characteristics of said bowable portion of said back-up roller.

5. In a twin-belt continuous metal-casting machine having a pair of casting belts revolving around respective belt-supporting carriages for defining a casting region between the two belts, and wherein each of the carriages has a frame with main rolls located at opposite ends of the carriage for revolving the casting belt around the carriage, and wherein the casting belts are guided and supported by a plurality of finned back-up rollers each extending transversely against the casting belt adjacent to the casting region, the method of controlling the shape of the casting region and the parameters affecting contact between the two belts and the metal being cast comprising the steps of:

predetermining the "head" of the molten metal at various longitudinal positions between the belts in the casting region, predetermining the relative flexibility of the respective finned back-up rollers in a first carriage in a bending mode in the direction away from the casting region, allowing at least some of the finned back-up rollers within said first carriage to be elastically relatively flexibe by reason of their length being approximately equal to the width of a relatively wide casting region and by reason of their being supported only at or near their ends, causing at least some of the finned back-up rollers within the second carriage to be relatively rigid by reason of their being divided into segments, each of said segments being substantially shorter in length than the width of the casting region and being supported in the second carriage at the ends of each segment, said segments being so disposed as to constitute transversely a slightly convex belt back-up in the second carriage facing toward the casting region, and predetermining the transverse convex contour of each such segmented back-up roller to be comparable to the concave bending of the respective opposed back-up roller in the first carriage for casting a wide product of uniform thickness having a slightly arcuate transverse section.

6. In a twin-belt continuous casting machine, the method of controlling the shape of the casting region and the parameters affecting contact between the two belts and the metal being cast as claimed in claim 5, including the further step of:

snubbing said bending mode flexibility of at least one flexible back-up roller in said first carriage by causing a rolling support to become engaged by said roller after a predetermined deflection thereof has occurred.

7. In a twin-belt continuous metal casting machine, the method of controlling the shape of the casting region and the parameters affecting contact between the two belts and the metal being case as claimed in claim 6, including the further step of:

resiliently snubbing the bending mode flexiblity of said flexible roller by resiliently mounting a rollable support in said first carriage for engagement by said roller after a predetermined deflection of said roller has occurred.

8. In a twin-belt continuous casting machine, the method as claimed in claim 5, 6 or 7 including the further step of:

supporting the adjoining ends of the segments of the segmented back-up rollers in the second carriage by supports seated upon elastically resilient mounts.

9. In a twin-belt continuous casting machine, the method as claimed in claim 5, 6 or 7, wherein the first carriage is the upper carriage.

* * * * *